US008973811B2

(12) United States Patent
McLeod et al.

(10) Patent No.: US 8,973,811 B2
(45) Date of Patent: Mar. 10, 2015

(54) SHIPPING AND DISPLAY CONTAINER

(75) Inventors: Michael B. McLeod, Romeoville, IL (US); Noel J. Mertz, St. Charles, MO (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 1870 days.

(21) Appl. No.: 11/599,119

(22) Filed: Nov. 14, 2006

(65) Prior Publication Data

US 2008/0110789 A1 May 15, 2008

(51) Int. Cl.

| | |
|---|---|
| ***B65D 5/00*** | (2006.01) |
| ***B65D 5/54*** | (2006.01) |
| ***B65D 5/32*** | (2006.01) |
| ***B65D 5/68*** | (2006.01) |

(52) U.S. Cl.

CPC ..... *B65D 5/5495* (2013.01); *B65D 5/32* (2013.01); *B65D 5/68* (2013.01)

USPC ..... 229/120.09; 206/736; 206/745

(58) Field of Classification Search

CPC ..... B65D 5/5253; B65D 5/5445

USPC ..... 229/171, 126, 165, 120.09, 164, 193, 229/143, 147; 206/509, 736, 746, 745, 503, 206/775

See application file for complete search history.

(56) References Cited

U.S. PATENT DOCUMENTS

| | | | | |
|---|---|---|---|---|
| 3,737,094 | A | | 6/1973 | Beaver et al. |
| 3,942,630 | A | | 3/1976 | Phillips |
| 4,042,165 | A | * | 8/1977 | Elder ..... 229/135 |
| 4,053,101 | A | | 10/1977 | Hart, Jr. |
| 4,116,330 | A | | 9/1978 | Ellis |
| 4,184,625 | A | | 1/1980 | Stollberg et al. |
| 4,350,281 | A | | 9/1982 | Dornbusch et al. |
| 4,553,666 | A | | 11/1985 | Gullikson |
| 4,641,746 | A | * | 2/1987 | Dornbusch et al. ..... 206/565 |
| 5,007,580 | A | * | 4/1991 | Morrison et al. ..... 229/117.17 |
| 5,048,690 | A | * | 9/1991 | Zimmerman ..... 206/746 |
| 5,141,149 | A | | 8/1992 | Fulton |
| 5,163,609 | A | * | 11/1992 | Muise, Jr. ..... 229/113 |
| 5,277,360 | A | | 1/1994 | DeMott |
| 5,337,950 | A | | 8/1994 | Bower |
| 5,372,299 | A | | 12/1994 | Edgerton, Jr. et al. |
| 5,706,959 | A | | 1/1998 | Smith |
| 5,853,120 | A | | 12/1998 | McLeod et al. |
| 5,921,398 | A | * | 7/1999 | Carroll ..... 206/736 |
| 5,950,914 | A | | 9/1999 | Dunton et al. |
| 5,967,406 | A | | 10/1999 | Moorman |
| 5,979,746 | A | | 11/1999 | McLeod et al. |
| D419,440 | S | | 1/2000 | Hansen |
| 6,027,017 | A | | 2/2000 | Kuhn et al. |
| 6,129,211 | A | * | 10/2000 | Prakken et al. ..... 206/750 |
| 6,311,891 | B1 | | 11/2001 | Gardner |
| 6,357,654 | B1 | | 3/2002 | Gardner et al. |
| 6,386,369 | B2 | * | 5/2002 | Yuhas et al. ..... 206/746 |
| 6,431,364 | B1 | | 8/2002 | Saladyga |
| 6,435,403 | B1 | | 8/2002 | Giblin et al. |
| 6,464,131 | B1 | | 10/2002 | Blazevich |

(Continued)

*Primary Examiner* — Justin Larson
*Assistant Examiner* — Phillip Schmidt
(74) *Attorney, Agent, or Firm* — Armstrong Teasdale LLP

(57) ABSTRACT

A container is provided including a blank of sheet material having an interior surface and an opposing exterior surface. The blank forms the container having a front wall, a bottom wall, a back wall, a top wall, a first side wall and an opposing second side wall, the container defining a cavity, and at least the front wall defining a display area for facilitating displaying product contained within container.

20 Claims, 21 Drawing Sheets

(56) References Cited

U.S. PATENT DOCUMENTS

| | | | | |
|---|---|---|---|---|
| 6,481,619 | B1 * | 11/2002 | Jackson | 229/169 |
| 6,510,982 | B2 | 1/2003 | White et al. | |
| 6,523,692 | B2 * | 2/2003 | Gregory | 206/746 |
| 6,974,033 | B2 | 12/2005 | McLeod et al. | |
| 7,021,468 | B2 | 4/2006 | Cargile, Jr. | |
| 7,066,321 | B2 | 6/2006 | Kawaguchi et al. | |
| 7,083,048 | B2 | 8/2006 | Taylor et al. | |
| 2002/0130167 | A1 | 9/2002 | Riedi | |
| 2004/0074801 | A1 * | 4/2004 | Ritter et al. | 206/509 |
| 2004/0084350 | A1 | 5/2004 | Kim | |
| 2004/0099570 | A1 | 5/2004 | Cargile, Jr. | |
| 2004/0231296 | A1 | 11/2004 | Daniels | |
| 2004/0232038 | A1 | 11/2004 | Daniels | |
| 2004/0232039 | A1 | 11/2004 | Daniels | |
| 2005/0184139 | A1 | 8/2005 | Gasior | |
| 2006/0006096 | A1 * | 1/2006 | Funk | 206/746 |

* cited by examiner

SHIPPING AND DISPLAY CONTAINER

BACKGROUND OF THE INVENTION

This invention relates generally to containers and, more particularly, to stackable shipping and display containers and a method for constructing such containers.

At least some conventional display containers for transporting, storing and/or displaying product include walls that are secured together to provide sufficient structural support to allow the stacking of the display containers. However, such construction provides limited access to a cavity defined within the display container through an opening formed in a top surface and/or a side surface of the display container. In many conventional display containers, stacking shelves formed along the top edges of the display container further limit access to the cavity making it difficult to properly position product within the display container. Further, such construction limits a display area in which the product can be displayed at a point of sale.

BRIEF DESCRIPTION OF THE INVENTION

In one aspect, a container including a blank of sheet material having an interior surface and an opposing exterior surface is provided. The blank forms the container having a front wall, a bottom wall, a back wall, a top wall, a first side wall and an opposing second side wall, the container defining a cavity, and at least the front wall defining a display area for facilitating displaying product contained within container.

In another aspect, a method for constructing a container from a blank of sheet material is provided. The method includes providing the blank of sheet material. A first inner side panel is folded with respect to a bottom panel of the blank to form an inner portion of a first side wall. A second inner side panel is folded with respect to the bottom panel to form an inner portion of a second side panel opposing the first side panel. A back wall is coupled to each of the first inner side panel and the second inner side panel. A top panel is folded inwardly towards the bottom panel and with respect to the back panel to form a top wall. A first outer side panel is folded with respect to the top wall and coupling the first outer side panel to the first inner side panel to form the first side wall. A second outer side panel is folded with respect to the top wall and coupling the first outer side panel to the second inner side panel to form the second side wall.

In another aspect, a blank of sheet material for constructing a stackable twin-tray assembly is provided. The blank of sheet material has an interior surface and an opposing exterior surface. The blank includes a first tray portion and a substantially similar second tray portion coupled to the first tray portion along a coupling line. The first tray portion and the second tray portion define a cavity. Each of the first tray portion and the second tray portion further includes a bottom panel, a back panel and a top panel coupled together along preformed, generally parallel, fold lines. A first inner side panel and a second inner side panel are coupled to the bottom panel. The first inner side panel extends from a first side edge of the bottom panel and the second inner side panel extends from an opposing second side edge of the bottom panel. A first outer side panel and a second outer side panel are coupled to the top panel. The first outer side panel extends from a first side edge of the top panel and is configured for coupling to the first inner side panel. The second outer side panel extends from an opposing second side edge of the top panel and is configured for coupling to the second inner side panel for facilitating constructing the stackable twin-tray assembly.

In another aspect, a stackable twin-tray assembly constructed from a blank of sheet material is provided. The blank of sheet material includes a first tray portion and a second tray portion coupled to the first tray portion along a coupling line. The twin-tray assembly includes a first display tray constructed from the first tray portion and a second display tray constructed from the second tray portion. The first display tray is coupled to the second display tray along a line of separation to define a cavity within the twin-tray assembly. Each of the first display tray and the second display tray includes a bottom wall, a back wall, a top wall, a first side wall and an opposing second side wall.

In another aspect, a method is provided for constructing a stackable twin-tray assembly from a blank of sheet material, and forming a first display tray and a second display tray from the stackable twin-tray assembly. The method includes providing the blank of sheet material defining a bottom panel of the twin-tray assembly. The blank of sheet material includes a first tray portion and a second display portion coupled to the first tray portion along a coupling line defined in the bottom panel of the twin-tray assembly. A first side wall of the twin-tray assembly and a second side wall of the twin-tray assembly opposing the first side wall are formed. A first end wall of the twin-tray assembly is formed and defines a back wall of the first display tray. A second end wall of the twin-tray assembly opposing the first end wall is formed and defines a back wall of the second display tray. A first top wall of the twin-tray assembly is formed and defines a top wall of the first display tray. A second top wall of the twin-tray assembly is formed and defines a top wall of the second display tray.

In another aspect, a method is provided for constructing a stackable packaged container assembly. The method includes positioning a first container including a first stacking support extending about at least a portion of a perimeter of the first container with respect to a second container including a second stacking support extending about at least a portion of a perimeter of the second container such that the first stacking support opposes the second stacking support. A cover member is positioned over at least a portion of each of the first container and the second container. The cover member is coupled to each of the first container and the second container.

DETAILED DESCRIPTION OF THE INVENTION

Figure 1:
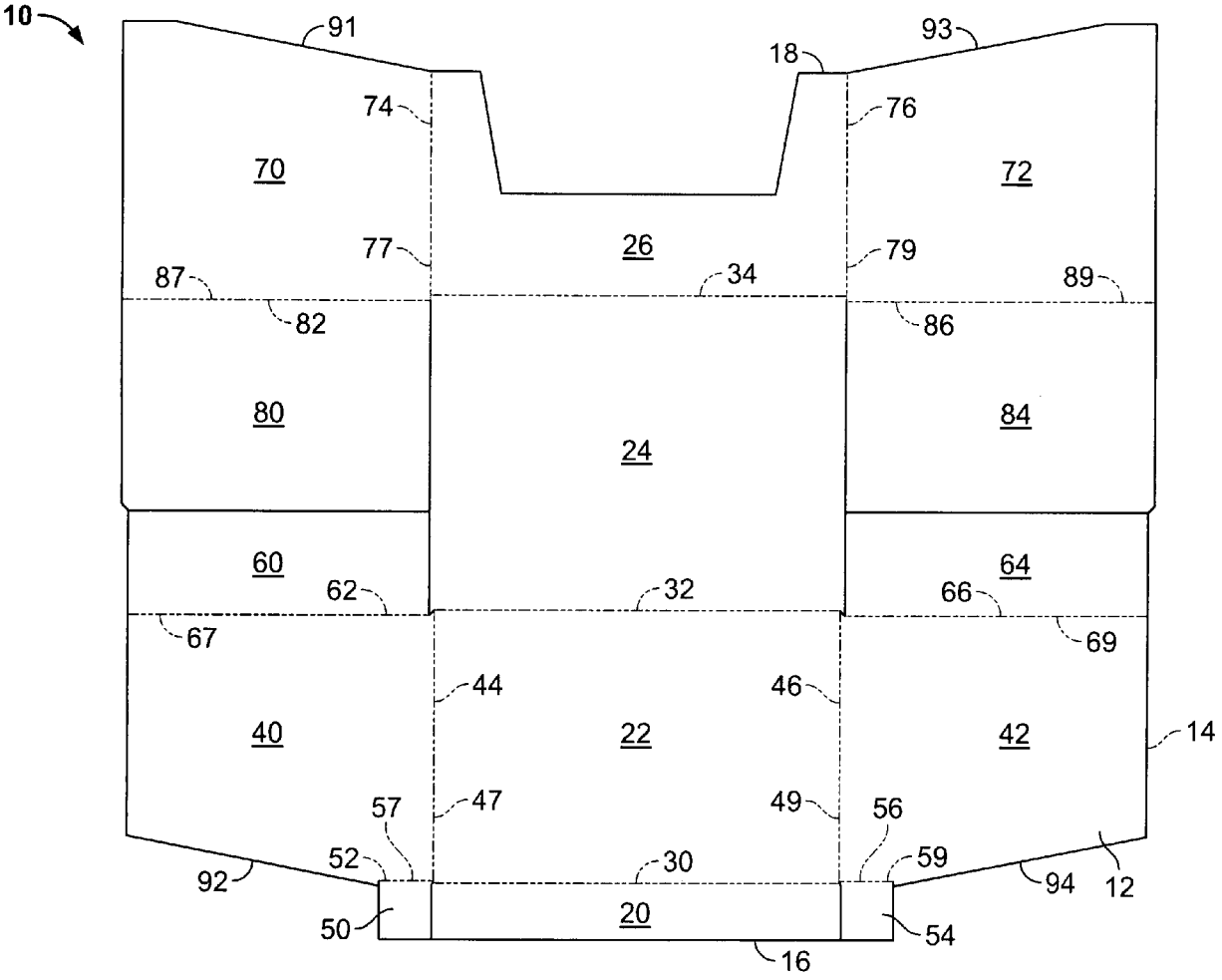
FIG. 1 is a top plan view of a blank of sheet material for constructing a container, according to one embodiment of this invention.

The present invention provides a stackable shipping and display container, as well as a method for constructing the shipping and display container. In one embodiment, the shipping and display container includes a front wall and opposing side walls that define an open display area while providing sufficient strength to allow stacking of a plurality of shipping and display containers.

The present invention is described below in reference to its application in connection with and operation of a shipping and display container. In one embodiment, two containers containing product are coupled together and packaged for shipping to a merchandising destination. In this embodiment, each individual container forms a stacking support about at least a portion of a perimeter of the container to facilitate stacking packaged containers. A cover member is positioned about at least a portion of the containers to facilitate retaining the containers positioned with respect to each other. The containers are coupled to the cover member using a coupling mechanism such as strapping, stretch banding and/or shrink film. After the packaged containers reach the merchandising destination, the coupling mechanism and the cover member are removed and each container is positioned with a display area visible to consumers to facilitate displaying the product contained within the containers. In an alternative embodiment, a twin-tray assembly is constructed from a blank of sheet material and configured for facilitating stacking the twin-tray assemblies during transport. At the merchandising destination, the shipping container is convertible into two display trays. Each display tray defines a display area for displaying the product contained within the twin-tray assembly. It will be apparent to those skilled in the art and guided by the teachings herein provided that the invention is likewise applicable to any suitable storage, shipping and/or display container including, without limitation, a carton, a tray or a box.

In one embodiment, the container is fabricated from a paperboard material. The container, however, may be fabricated using any suitable material, and therefore is not limited to a specific type of material. In alternative embodiments, the container is fabricated using cardboard, corrugated board, plastic and/or any suitable material known to those skilled in the art and guided by the teachings herein provided.

In a particular embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. The container may have any suitable size, shape and/or configuration, i.e., any suitable number of sides having any suitable size, shape and/or configuration as described and/or illustrated herein. In one embodiment, the container includes a shape that provides functionality, such as a shape that facilitates transporting the container and/or a shape that facilitates stacking and/or arrangement of a plurality of containers.

Figure 2:
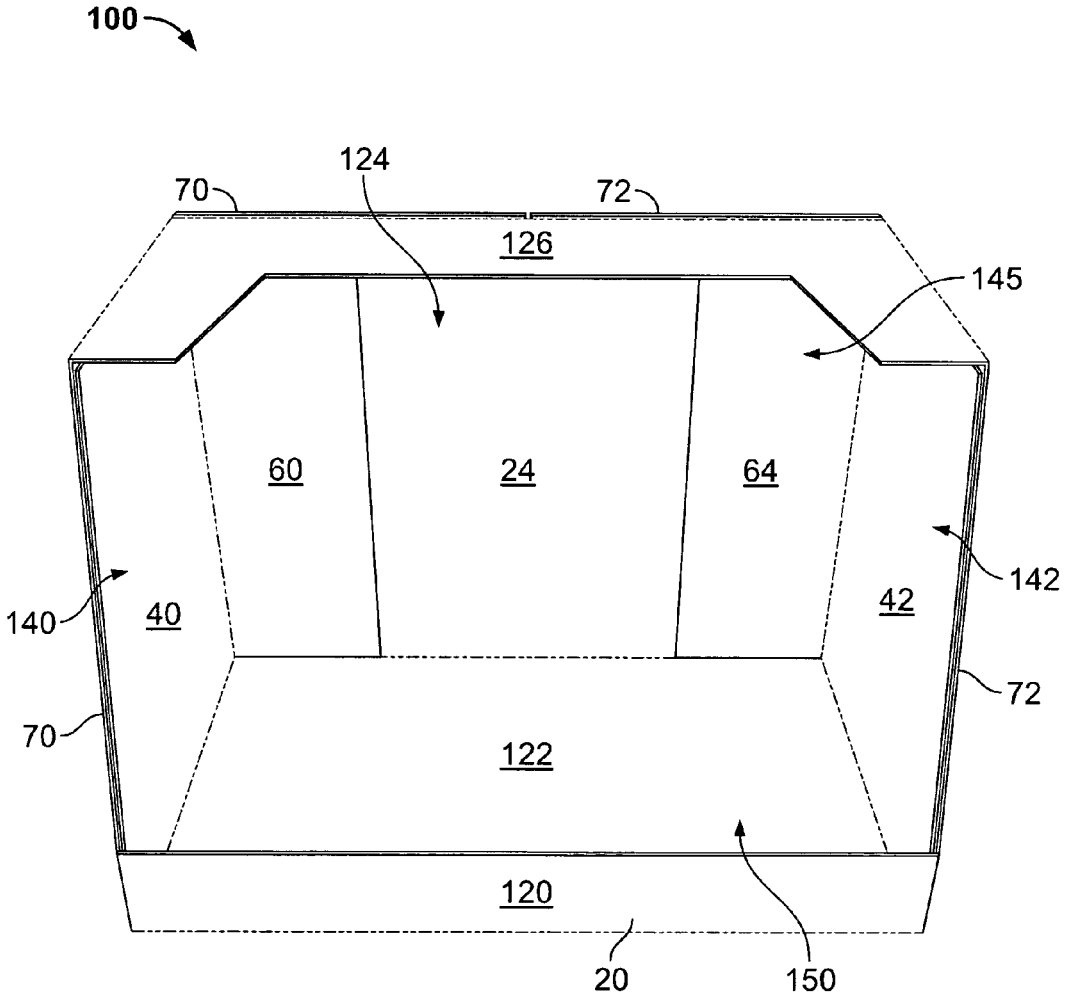
FIG. 2 is a perspective view of a container constructed from the blank shown in FIG. 1.

Referring now to the drawings, and more specifically to FIGS. 1 and 2, although as described above a container may have any suitable size, shape and/or configuration, FIGS. 1 and 2 illustrate the construction or formation of one embodiment of a container. Specifically, FIG. 1 is a top plan view of one embodiment of a blank of sheet material 10. FIG. 2 is a perspective view of one embodiment of a container 100 formed from blank 10 shown in FIG. 1.

Referring to FIG. 1, blank 10 has a first or interior surface 12 and an opposing second or exterior surface 14. Further, blank 10 defines a leading edge 16 and an opposing trailing edge 18. Blank 10 has a corrugation direction generally perpendicular to a length of blank 10 defined between leading edge 16 and trailing edge 18. In one embodiment, blank 10 includes, from leading edge 16 to trailing edge 18, a front panel 20, a bottom panel 22, a back panel 24 and a top panel 26 coupled together along preformed, generally parallel, fold lines 30, 32 and 34, respectively. More specifically, bottom panel 22 extends from front panel 20 along respective fold line 30, back panel 24 extends from bottom panel 22 along respective fold line 32 and top panel 26 extends from back panel 24 along respective fold line 34. Fold lines 30, 32 and 34, as well as other fold lines described herein, may include any suitable line of weakening and/or line of separation known to those skilled in the art and guided by the teachings herein provided.

As shown in FIG. 1, in one embodiment a first inner side panel 40 and a second inner side panel 42 are coupled to bottom panel 22 along preformed, generally parallel, fold lines 44 and 46, respectively. Specifically, first inner side panel 40 extends from a first side edge 47 of bottom panel 22 along fold line 44. Second inner side panel 42 extends from an opposing second side edge 49 of bottom panel 22 along fold line 46. A first front flap 50 is coupled to first inner side panel 40 along preformed fold line 52 and a second front flap 54 is coupled to second inner side panel 42 along preformed fold line 56. Specifically, first front flap 50 extends from a first side edge 57 of first inner side panel 40 along fold line 52 and generally perpendicular to first side edge 47. Second front flap 54 extends from a first side edge 59 of second inner side panel 42 along fold line 56 and generally perpendicular to second side edge 49.

A first inner back panel 60 is coupled to first inner side panel 40 along preformed fold line 62 and a second inner back panel 64 is coupled to second inner side panel 42 along preformed fold line 66. Specifically, first inner back panel 60 extends from a second side edge 67 of first inner side panel 40 along fold line 62 and generally parallel to first side edge 57. Second inner back panel 64 extends from a second side edge 69 of second inner side panel 42 along fold line 66 and generally parallel to side edge 59. Referring further to FIG. 1, second side edge 67 of first inner side panel 60 and second side edge 69 of second inner back panel 64 are generally parallel to and offset with respect to fold line 32 to compensate for a thickness of first inner back panel 60 and second inner back panel 64, respectively, when container 100 is constructed from blank 10, as described in greater detail below.

As shown in FIG. 1, a first outer side panel 70 and a second outer side panel 72 are coupled to top panel 26 along preformed, generally parallel, fold lines 74 and 76, respectively. Specifically, first outer side panel 70 extends from a first side edge 77 of top panel 26 along fold line 74. Second outer side panel 72 extends from an opposing second side edge 79 of top panel 26 along fold line 76. A first outer back panel 80 is coupled to first outer side panel 70 along preformed fold line 82 and a second outer back panel 84 is coupled to second outer side panel 72 along preformed fold line 86. Specifically, first outer back panel 80 extends from a first side edge 87 of first outer side panel 70 along fold line 82 and generally perpendicular to first side edge 77. Second outer back panel 84 extends from a first side edge 89 of second outer side panel 72 along fold line 86 and generally perpendicular to second side edge 79.

Referring further to FIG. 1, first side edge 87 of first outer side panel 70 and first side edge 89 of second outer side panel 72 are generally parallel to and offset with respect to fold line 34 to compensate for a thickness of back panel 24 when container 100 is constructed from blank 10, as described in greater detail below. Further, a second side edge 91 of first outer side panel 70 generally opposing first side edge 87 tapers outwardly with respect to side edge 77 of top panel 26 at an angle corresponding to an angle at which a front edge 92 of inner side panel 40 tapers outwardly with respect to first side edge 47 of bottom panel 22. Additionally, a second side edge 93 of second outer side panel 72 generally opposing first side edge 89 tapers outwardly with respect to side edge 79 of top panel 26 at an angle corresponding to an angle at which a front edge 94 of second inner side panel 42 tapers outwardly with respect to second side edge 49 of bottom panel 22. In one embodiment, when container 100 is constructed, side edge 91 is aligned with front edge 92 and side edge 93 is aligned with front edge 94 to at least partially defined respective side edges of container 100.

FIG. 2 shows container 100 constructed from blank 10. In one embodiment, container 100 is constructed from blank 10 by folding blank 10 about the fold lines. In a particular embodiment, an adhesive material is applied to portions of blank 10 to secure selected portions of container 100 together. Container 100 includes a front wall 120, a bottom wall 122, a back wall 124, a top wall 126, a first side wall 140 and an opposing second side wall 142. More specifically, front wall 120 includes front panel 20 and front flaps 50, 54. Back wall 124 includes inner back panels 60, 64 coupled to interior surface 12 of back panel 24 and outer side panels 70, 72 coupled to exterior surface 14 of back panel 24. First side wall 140 includes first inner side panel 40 and first outer side panel 70 coupled to exterior surface 14 of first inner side panel 40. Second side wall 142 include second inner side panel 42 and second outer side panel 72 coupled to exterior surface 14 of second inner side panel 42. Container 100 is constructed to define a cavity 145. As shown in FIG. 2, front wall 120 defines a display area 150 for facilitating displaying product contained within container 100. In one embodiment, at least a portion of display area 150 is further defined by first side wall 140, second side wall 142 and/or top wall 126.

In one embodiment, container 100 is constructed using a machine (not shown) and is configured in a fully constructed configuration, as shown in FIG. 2. In this embodiment, the machine is configured to apply a suitable adhesive material, such as a suitable glue material, to selected or desired portions of blank 10 to secure selected components of container 100 together. For example, an adhesive material may be applied to an outer surface of front flaps 50, 54 and/or an inner surface of front wall 120 to adhesively couple front panel 20 to front flaps 50, 54 to form front wall 120; an adhesive material may be applied to an outer surface of inner back panels 60, 64 and/or an inner surface of outer back panels 80, 82 to adhesively couple inner back panels 60, 64 or outer back panels 80, 82, respectively, to back panel 24 to form back wall 124; and/or an adhesive material may be applied to an outer surface of inner side panels 40, 42 and/or to an inner surface of outer side panels 70, 72 to adhesively couple inner side panels 40, 42 to outer side panels 70, 72, respectively to form side walls 140, 142, respectively.

Figure 3:
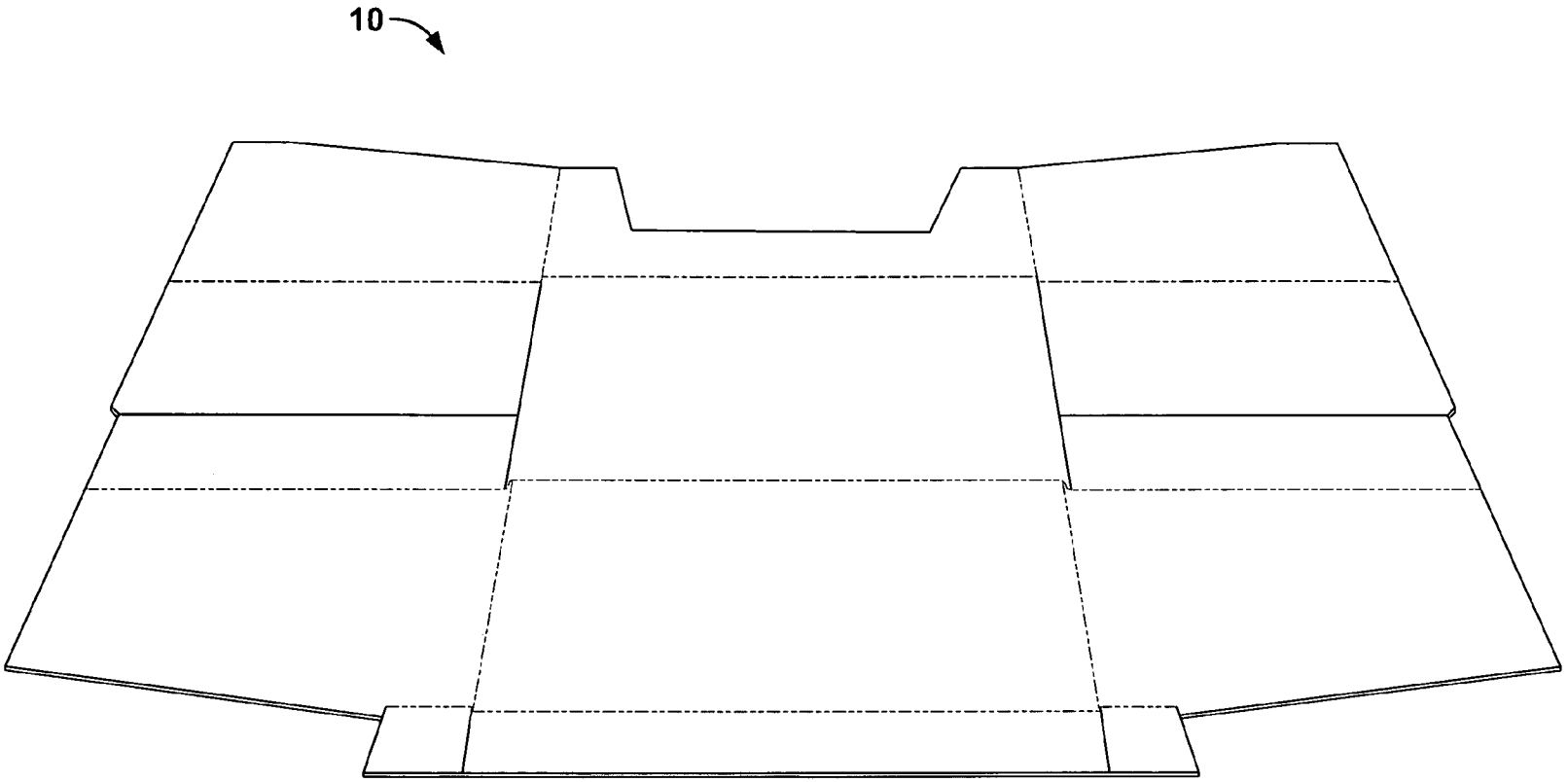
FIGS. 3-8 illustrate a method for constructing the container shown in FIG. 2 from the blank of sheet material shown in FIG. 1.
Figure 4:
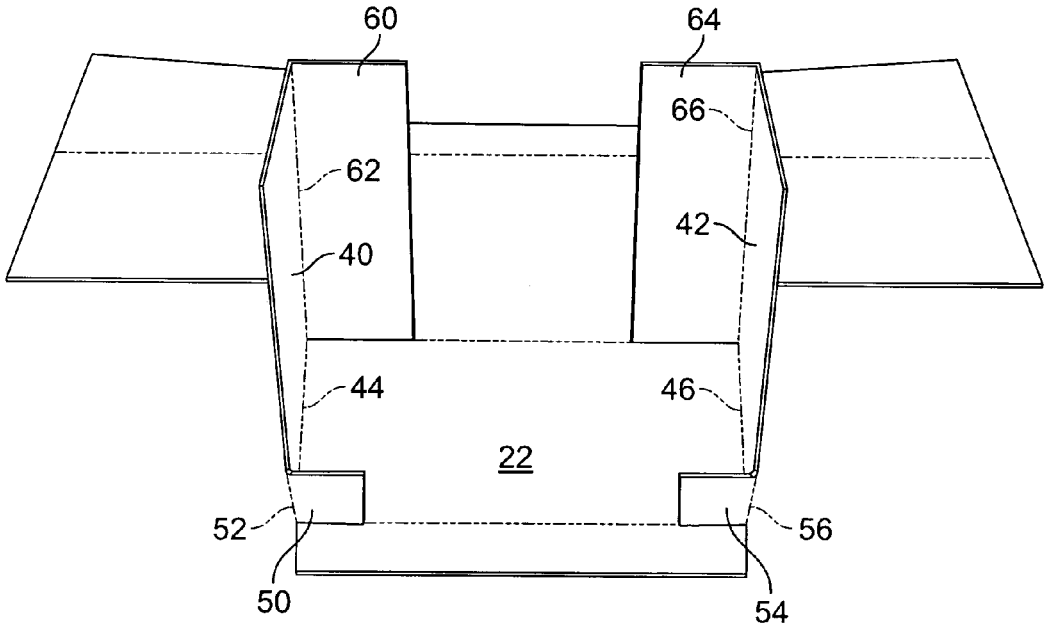
Figure 6:
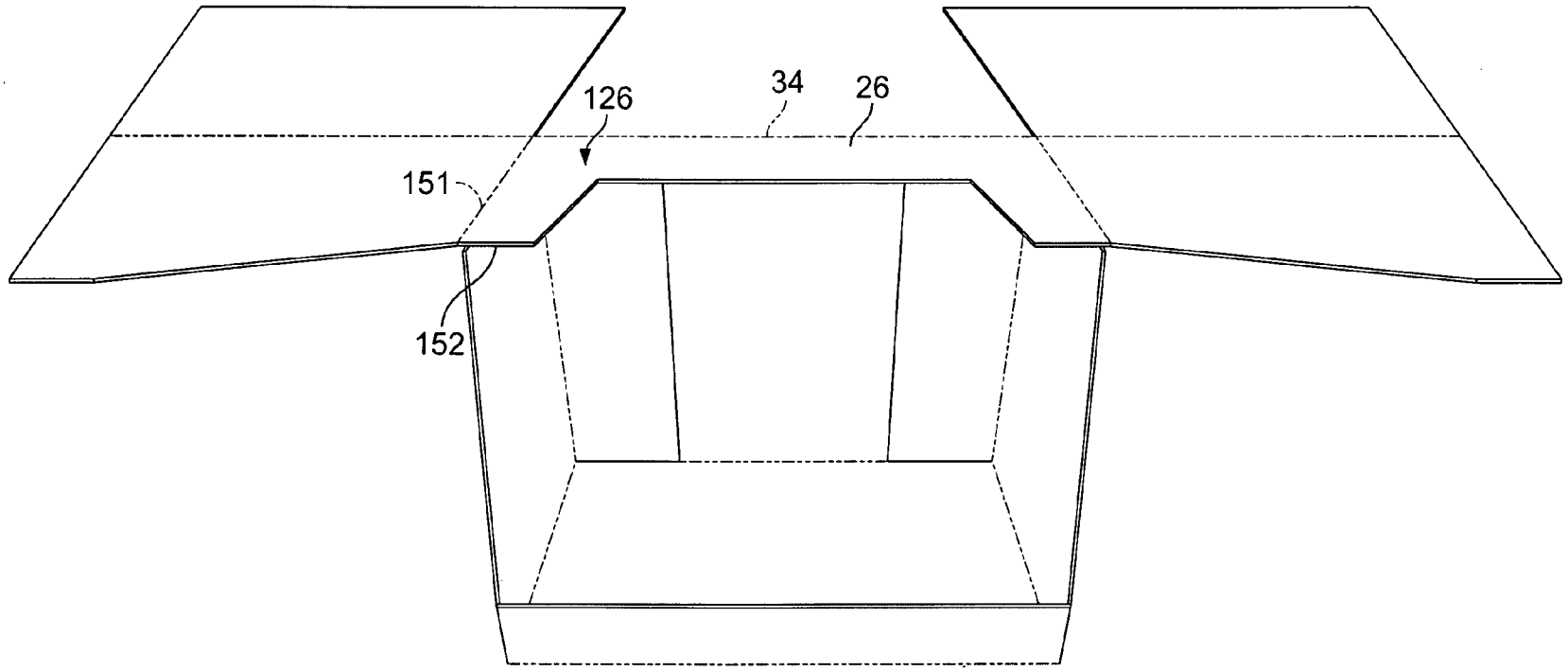
Figure 7:
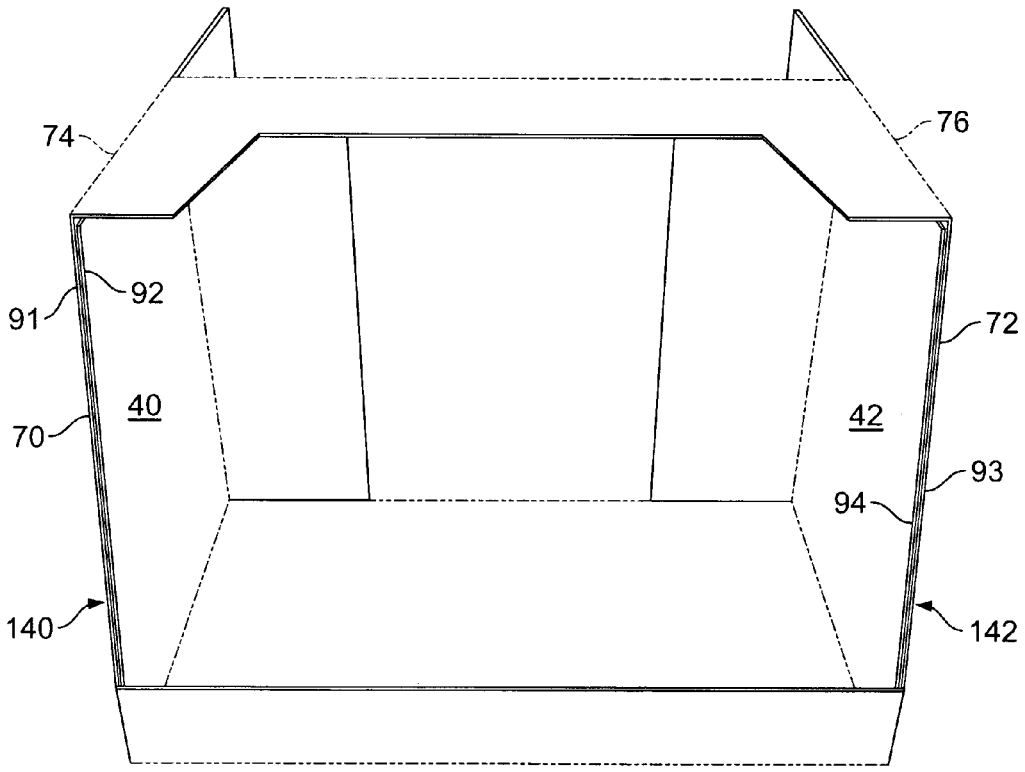
Figure 8:
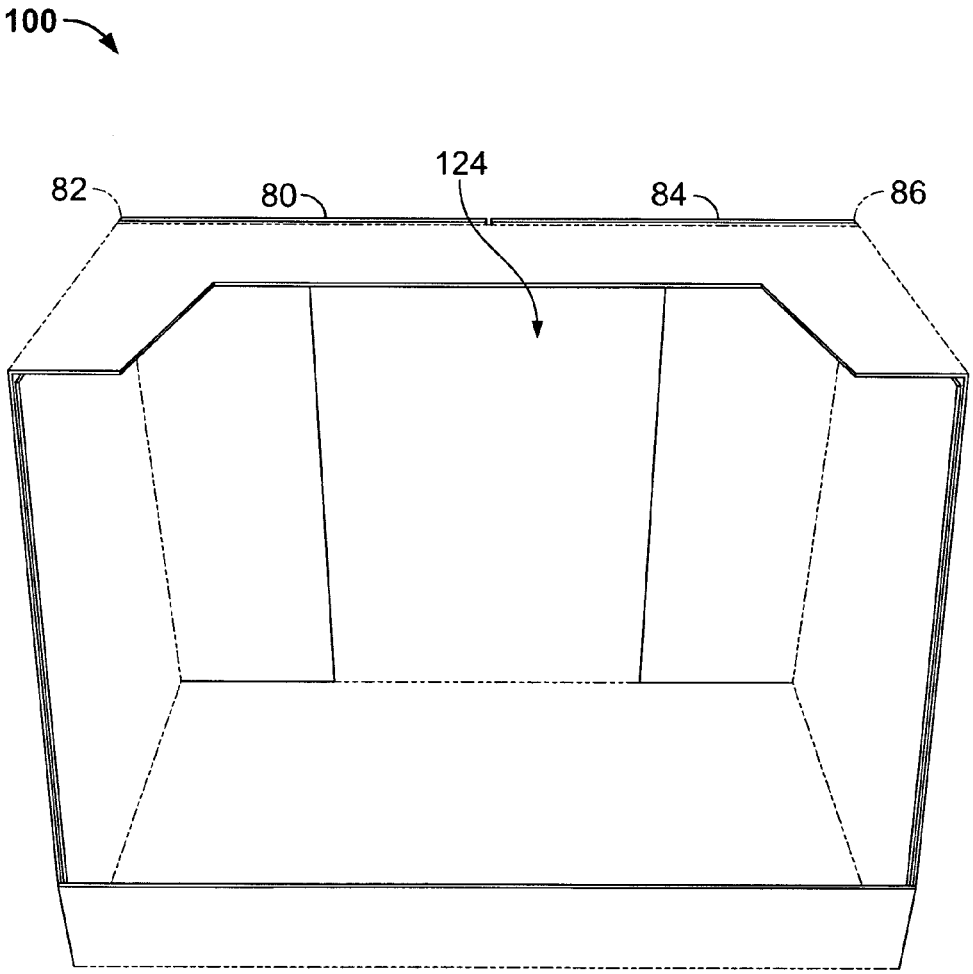

Referring further to FIGS. 3-8, in one embodiment a method for constructing container 100 from blank 10 is provided. A blank 10, as shown in FIG. 3, is provided to construct container 100, as shown in FIG. 8, either manually or using a suitable container constructing machine known to those skilled in the art and guided by the teachings herein provided (not shown). As shown in FIG. 4, first inner side panel 40 is folded along fold line 44 with respect to bottom panel 22. First inner back panel 60 is folded along fold line 62 with respect first inner side panel 40 towards bottom panel 22 and first front flap 50 is folded along fold line 52 with respect to first inner side panel 40 towards bottom panel 22. Similarly, second inner side panel 42 is folded along fold line 46 with respect to bottom panel 22. Second inner back panel 64 is folded along fold line 66 with respect second inner side panel 42 towards bottom panel 22 and second front flap 54 is folded along fold line 56 with respect to second inner side panel 42 towards bottom panel 22.

Figure 5:
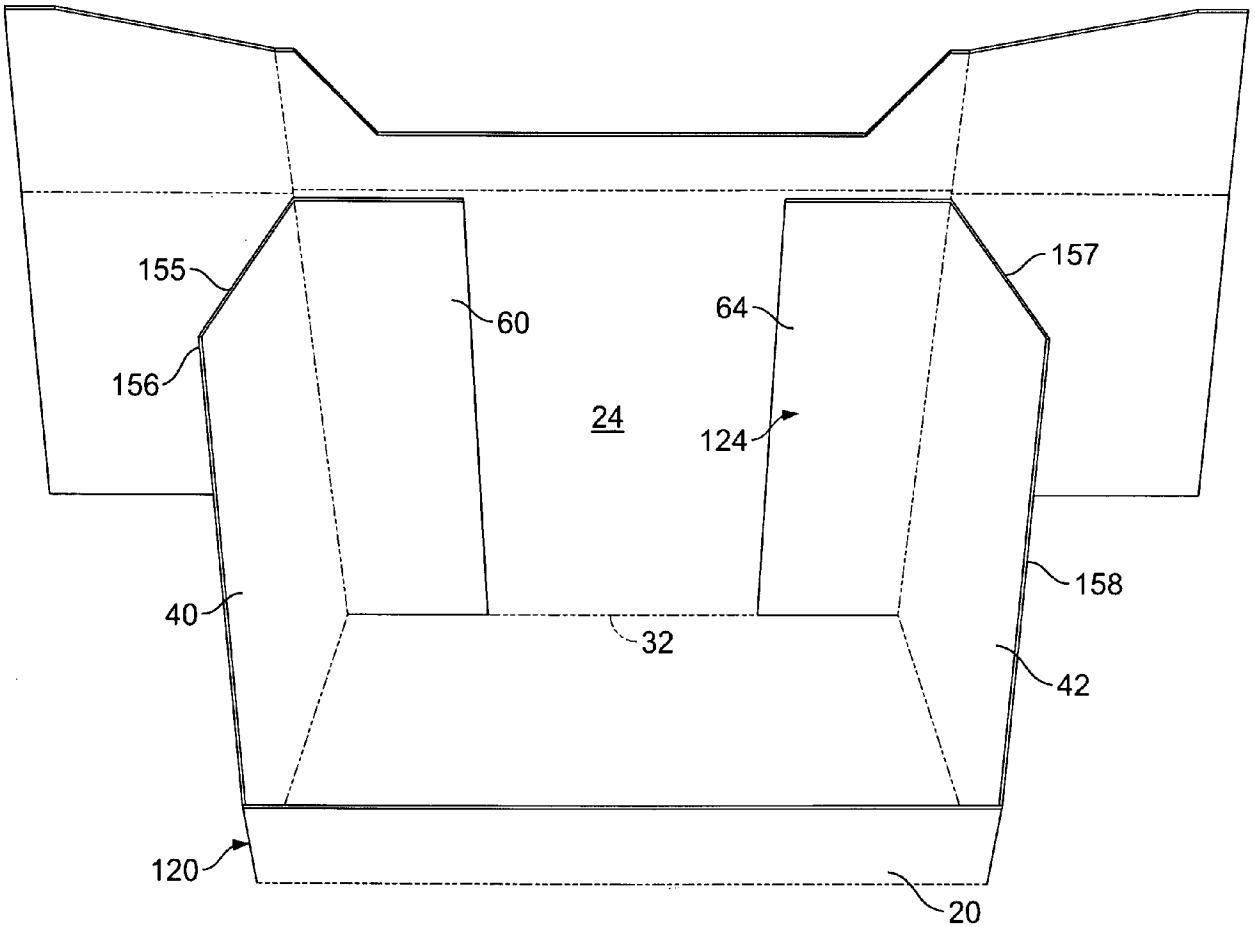

Referring further to FIG. 5, with first inner side panel 40 and second inner side panel 42 folded with respect to bottom panel 22, front panel 20 is coupled to each of first front flap 50 and second front flap 54 using a suitable coupler, such as an adhesive material, to form front wall 120. Back panel 24 is folded along fold line 32 with respect to bottom panel 22 and coupled to each of first inner back panel 60 and second inner back panel 64 using a suitable coupler, such as an adhesive material, to partially form back wall 124. Top panel 26 is then folded along fold line 34 with respect to back panel 24 to form top wall 126, as shown in FIG. 6. Referring to FIGS. 5 and 6, top wall 126 has a depth 151 defined between fold line 34 and a front edge 152 substantially equal to a width of a top edge 155 of first inner side panel 40 defined between fold line 62 and a front edge 156 of first inner side panel 40 and a top edge 157 of second inner side panel 42 defined between fold line 66 and a front edge 158 of second inner side panel 42.

First outer side panel 70 is folded along fold line 74 with respect to top panel 26 towards first inner side panel 40 and coupled to first inner side panel 40 using a suitable coupler, such as an adhesive material, to form first side wall 140, as shown in FIG. 7. With first side wall 140 formed, edge 91 of first outer side panel 70 is aligned with edge 92 of first inner side panel 40. Similarly, second outer side panel 72 is folded along fold line 76 with respect to top panel 26 towards second inner side panel 42 and coupled to second inner side panel 42 using a suitable coupler, such as an adhesive material, to form second side wall 142. With second side wall 142 formed, edge 93 of second outer side panel 72 is aligned with edge 94 of second inner side panel 42.

As shown in FIG. 8, first outer back panel 80 is folded along fold line 82 with respect to first outer side panel 70 towards exterior surface 14 of back panel 24. First outer back panel 80 is coupled to back panel 24 using a suitable coupler, such as an adhesive material. Second outer back panel 84 is folded along fold line 86 with respect to second outer side panel 72 towards exterior surface 14 of back panel 24. Second outer back panel 84 is coupled to back panel 24 using a suitable coupler, such as an adhesive material, to form back wall 124.

Each constructed container is loaded with a product and a plurality of loaded containers are prepared for shipping to a merchandising destination. In one embodiment, for example, two loaded containers are coupled together and packaged in the form of a packaged container assembly for shipping to the merchandising destination. In this embodiment, individual containers 100 are positioned such that front wall 120 of a first container 100 faces and contacts a front wall 120 of a second container 100. With front wall 120 of first container 100 contacting front wall 120 of second container 100, back wall 124, alone or in combination with top wall 126, first side wall 140 and/or second side wall 142 of each container 100, provides an opposing stacking support about at least a portion of a perimeter of the coupled containers, as described in greater detail below in reference to FIGS. 11-13.

In one embodiment, the packaged container assembly includes a suitable cover member, such as an inverted U-shaped tray or other suitable tray, or a pad, that covers at least a portion of first container 100 and/or second container 100 to facilitate retaining first container 100 positioned with respect to second container 100. In a particular embodiment, the cover member includes opposing side walls and/or opposing end walls that are positioned about corresponding back wall 124, top wall 126, first side wall 140 and/or second side wall 142 of each container 100 to retain first container 100 positioned with respect to second container 100. Containers 100 are coupled to the cover member using a suitable coupling mechanism including, without limitation, strapping, stretch banding and/or shrink film. Such packaging of two or more containers 100 in the packaged container assembly provides opposing stacking supports to facilitate stacking containers 100 containing product packaged in a primary package, such as a gable top carton or a flexible pouch, that do not have a necessary stacking strength to support stacking such primary packages. After the packaged container assemblies reach the merchandising destination, the coupling mechanism and the cover member are removed. Each container 100 is positionable, such as placed on a shelf, with display area 150 visible to consumers to facilitate displaying the product contained within container 100.

Figure 9:
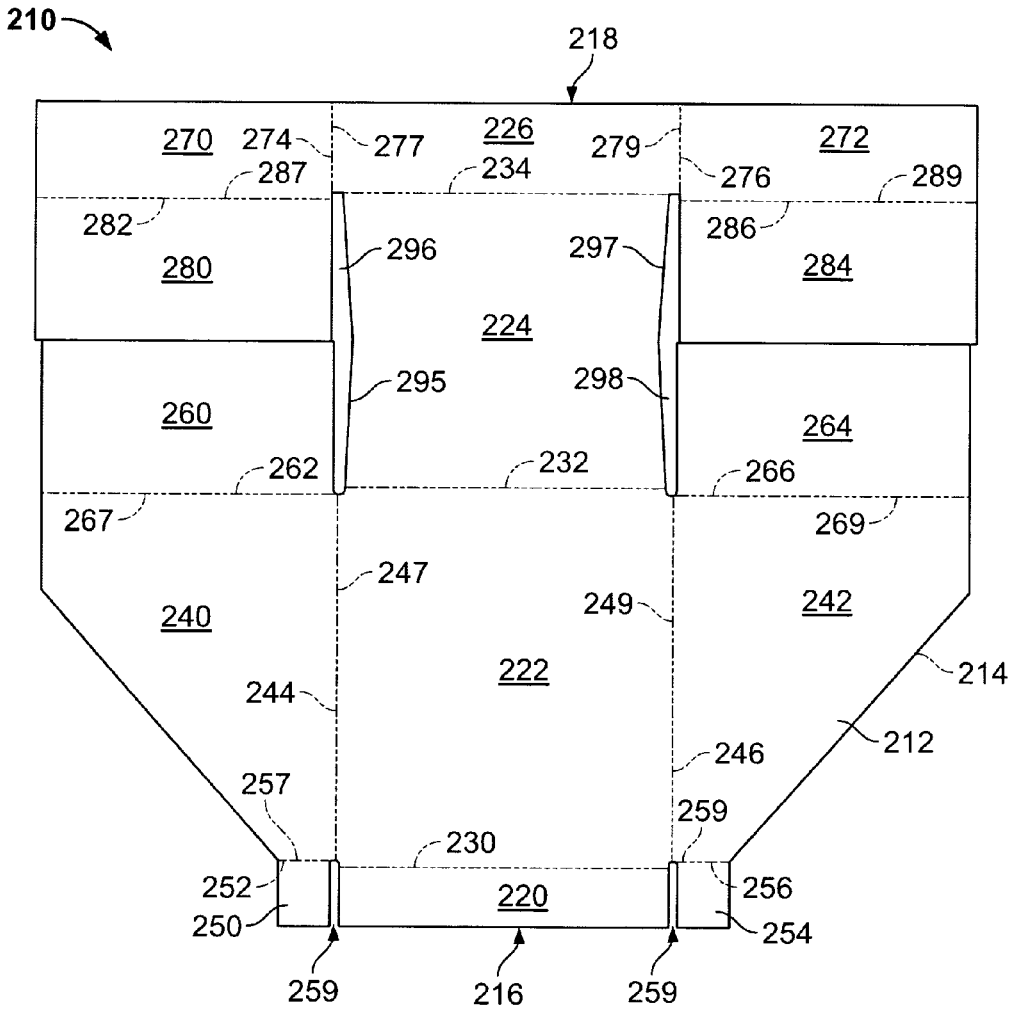
FIG. 9 is a top plan view of a blank of sheet material for constructing a container, according to one embodiment of this invention.
Figure 10:
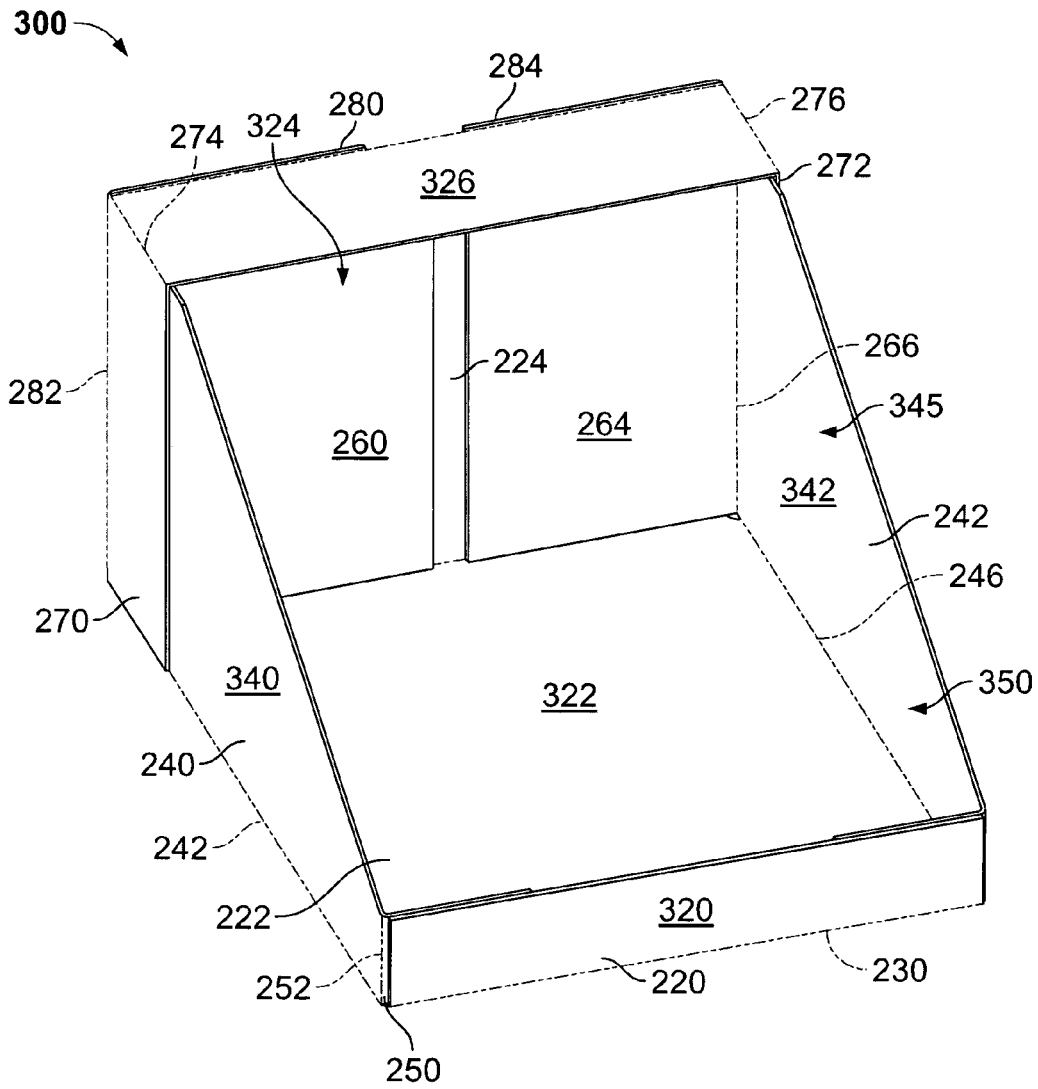
FIG. 10 is a perspective view of a container constructed from the blank shown in FIG. 9.

FIGS. 9 and 10 illustrate the construction or formation of one embodiment of a container. Specifically, FIG. 9 is a top plan view of one embodiment of a blank of sheet material 210. FIG. 10 is a perspective view of one embodiment of a container 300 formed from blank 210 shown in FIG. 9.

Referring to FIG. 9, blank 210 has a first or interior surface 212 and an opposing second or exterior surface 214. Further, blank 210 defines a leading edge 216 and an opposing trailing edge 218. Blank 210 has a corrugation direction generally perpendicular to a length of blank 210 defined between leading edge 216 and trailing edge 218. In one embodiment, blank 210 includes, from leading edge 216 to trailing edge 218, a front panel 220, a bottom panel 222, a back panel 224 and a top panel 226 coupled together along preformed, generally parallel, fold lines 230, 232 and 234, respectively. More specifically, bottom panel 222 extends from front panel 220 along respective fold line 230, back panel 224 extends from bottom panel 222 along respective fold line 232 and top panel 226 extends from back panel 224 along respective fold line 234. Fold lines 230, 232 and 234, as well as other fold lines described herein, may include any suitable line of weakening and/or line of separation known to those skilled in the art and guided by the teachings herein provided.

As shown in FIG. 9, in one embodiment a first inner side panel 240 and a second inner side panel 242 are coupled to bottom panel 222 along preformed, generally parallel, fold lines 244 and 246, respectively. Specifically, first inner side panel 240 extends from a first side edge 247 of bottom panel 222 along fold line 244. Second inner side panel 242 extends from an opposing second side edge 249 of bottom panel 222 along fold line 246. A first front flap 250 is coupled to first inner side panel 240 along preformed fold line 252 and a second front flap 254 is coupled to second inner side panel 242 along preformed fold line 256. Specifically, first front flap 250 extends from a first side edge 257 of first inner side panel 240 along fold line 252 and generally perpendicular to first side edge 247. Second front flap 254 extends from a first side edge 258 of second inner side panel 242 along fold line 256 and generally perpendicular to second side edge 249. In this embodiment, each of first front flap 250 and second front flap 254 are separated from front panel 220 to at least partially define a space 259 between first front flap 250 and front panel 220 and between second front flap 254 and front panel 220, respectively. Referring further to FIG. 9, first side edge 257 of first front flap 250 and first side edge 258 of second front flap 254 are generally parallel to and offset with respect to fold line 230 to compensate for a thickness of first front flap 250 and second front flap 254, respectively, when container 300 is constructed from blank 210, as described in greater detail below.

A first inner back panel 260 is coupled to first inner side panel 240 along preformed fold line 262 and a second inner back panel 264 is coupled to second inner side panel 242 along preformed fold line 266. Specifically, first inner back panel 260 extends from a second side edge 267 of first inner side panel 240 along fold line 262 and generally parallel to first side edge 257. Second inner back panel 264 extends from a second side edge 269 of second inner side panel 242 along fold line 266 and generally parallel to side edge 258. Referring further to FIG. 9, second side edge 267 of first inner side panel 260 and second side edge 269 of second inner side panel 264 is generally parallel to and offset with respect to fold line 232 to compensate for a thickness of first inner back panel 260 and second inner back panel 264, respectively, when container 300 is constructed from blank 210, as described in greater detail below.

As shown in FIG. 9, a first outer side panel 270 and a second outer side panel 272 are coupled to top panel 226 along preformed, generally parallel, fold lines 274 and 276, respectively. Specifically, first outer side panel 270 extends from a first side edge 277 of top panel 226 along fold line 274. Second outer side panel 272 extends from an opposing second side edge 279 of top panel 226 along fold line 276. A first outer back panel 280 is coupled to first outer side panel 270 along preformed fold line 282 and a second outer back panel 284 is coupled to second outer side panel 272 along preformed fold line 286. Specifically, first outer back panel 280 extends from a first side edge 287 of first outer side panel 270 along fold line 282 and generally perpendicular to first side edge 277. Second outer back panel 284 extends from a first side edge 289 of second outer side panel 272 along fold line 286 and generally perpendicular to second side edge 279.

Referring further to FIG. 9, first side edge 287 of first outer side panel 270 and first side edge 289 of second outer side panel 272 are generally parallel to and offset with respect to fold line 234 to compensate for a thickness of back panel 224 when container 300 is constructed from blank 210, as described in greater detail below.

As shown in FIG. 9, a first side edge 295 of back panel 224 tapers inwardly from fold line 232 and fold line 234 to converge at an apex. At fold line 234 side edge 295 is offset with respect to fold line 274 coupling first outer side panel 270 to top panel 226. As such, side edge 295 at least partially defines a void 296 between back panel 224, top panel 226, first outer side panel 270, first outer back panel 280, first inner back panel 260, first inner side panel 240 and/or bottom panel 222. Similarly, a second side edge 297 of back panel 224 tapers inwardly from fold line 232 and fold line 234 to converge at an apex. At fold line 234 side edge 297 is offset with respect to fold line 276 coupling second outer side panel 272 to top panel 226. As such, side edge 297 at least partially defines a void 298 between back panel 224, top panel 226, second outer side panel 272, second outer back panel 284, second inner back panel 264, second inner side panel 242 and/or bottom panel 222.

FIG. 10 shows container 300 constructed from blank 210. In one embodiment, container 300 is constructed from blank 210 by folding blank 210 about the fold lines. In one embodiment, an adhesive material is applied to portions of blank 210 to secure selected portions of container 300 together. Container 300 includes a front wall 320, a bottom wall 322, a back wall 324, a top wall 326, a first side wall 340 and an opposing second side wall 342. More specifically, front wall 320 includes front panel 220 and front flaps 250, 254. Back wall 324 includes inner back panels 260, 264 coupled to interior surface 212 of back panel 224 and outer back panels 280, 284 coupled to exterior surface 214 of back panel 224. First side wall 340 includes first inner side panel 240 and first outer side panel 270 coupled to exterior surface 214 of first inner side panel 240. Second side wall 342 include second inner side panel 242 and second outer side panel 272 coupled to exterior surface 214 of second inner side panel 242. Container 300 is constructed to define a cavity 345. As shown in FIG. 10, front wall 320 defines a display area 350 for facilitating displaying product contained within container 300. In one embodiment, at least a portion of display area 350 is further defined by first side wall 340, second side wall 342 and/or top wall 326.

Figure 11:
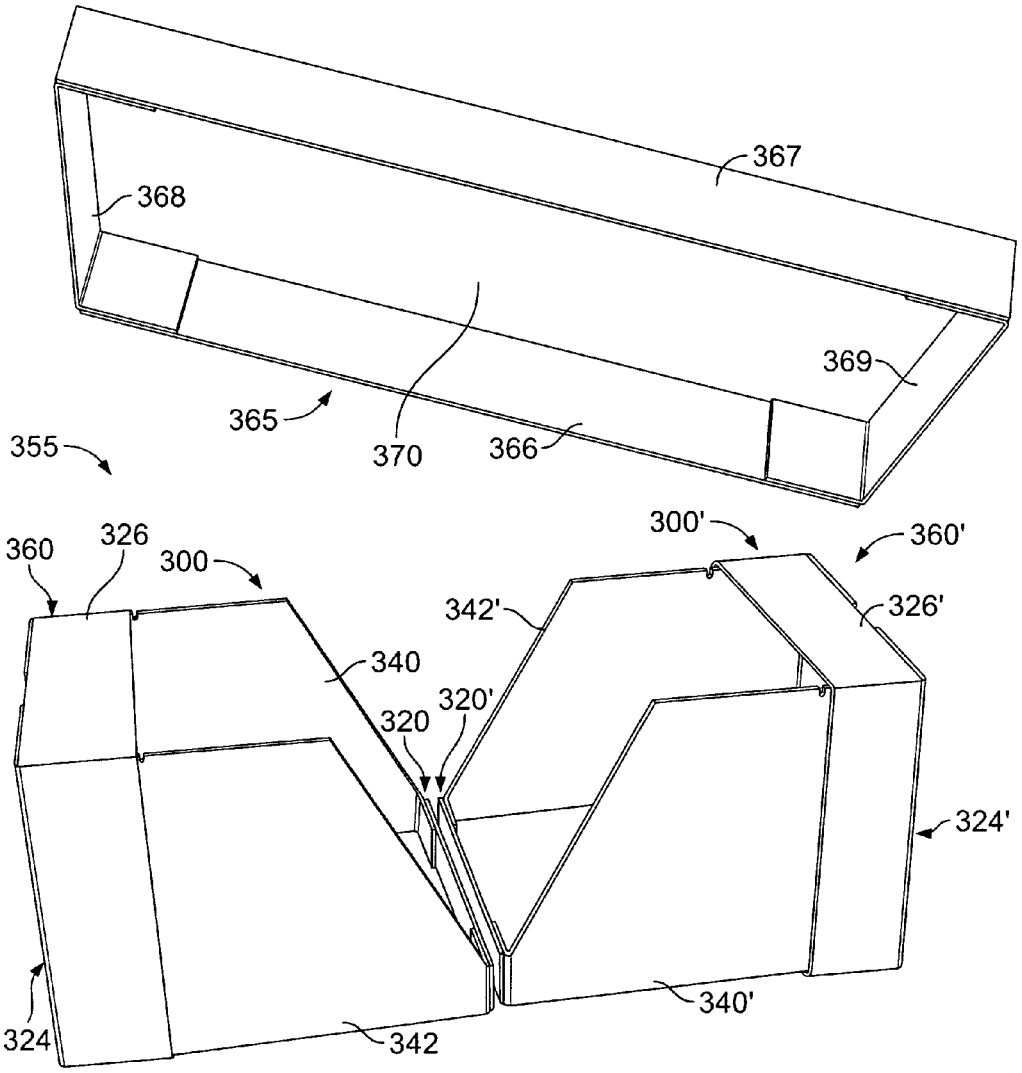
FIG. 11 is a side perspective view of two individual containers positioned with respect to each other for facilitating packaging the containers for shipping to a merchandising destination.
Figure 12:
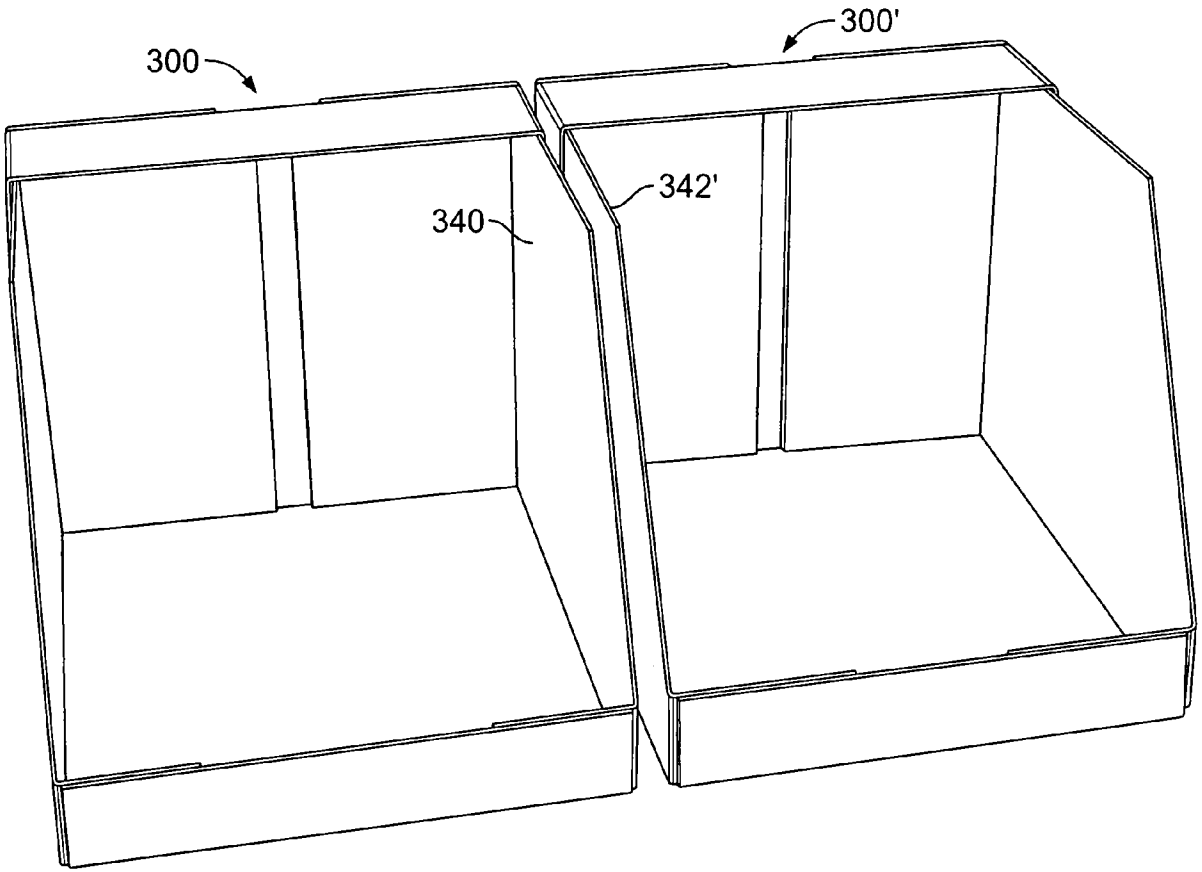
FIG. 12 is front perspective view of two containers positioned in a side-by side configuration for displaying product at a merchandising destination.
Figure 13:
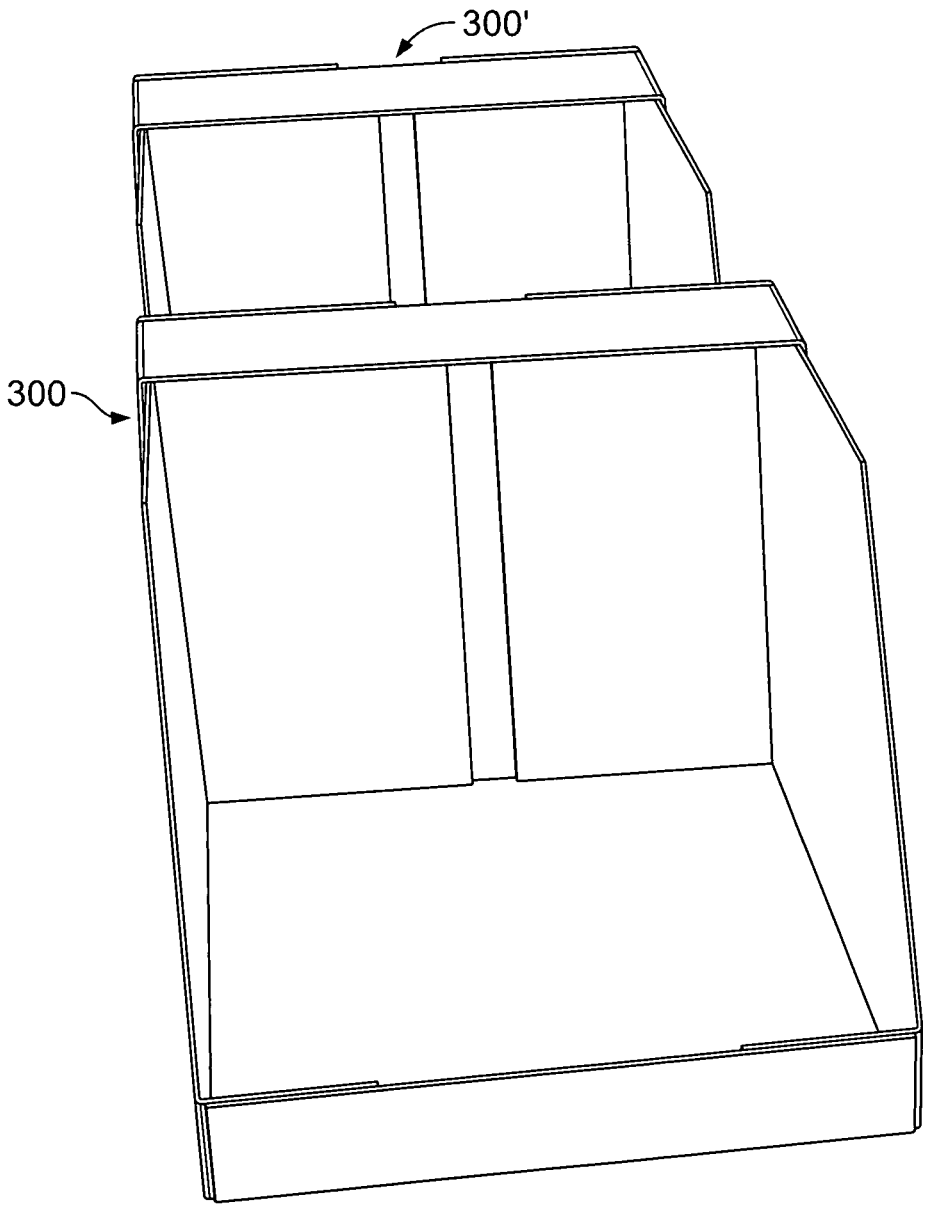
FIG. 13 is a front perspective view of two containers positioned in a front-to-back configuration for displaying product at a merchandising destination.

Referring further to FIGS. 11-13, each constructed container is loaded with a product and a plurality of loaded containers are prepared for shipping to a merchandising destination. In one embodiment as shown in FIG. 11, two loaded containers 300, 300' are coupled together and packaged for shipping to the merchandising destination in the form of a packaged container assembly 355. Although containers 300, 300' as shown in FIG. 11 do not contain product, such containers 300, 300' are loaded with product before containers 300, 300' are packaged for shipping. In this embodiment, individual containers 300, 300' are positioned such that front wall 320 of container 300 faces and contacts a front wall 320' of container 300'. With front wall 320 of container 300 contacting front wall 320' of container 300', back wall 324 of container 300, alone or in combination with top wall 326, first side wall 340 and/or second side wall 342, forms a stacking support, generally designated as 360, about at least a portion of a perimeter of container 300 to facilitate stacking packaged containers 300, 300'. Similarly, back wall 324' of container 300', alone or in combination with top wall 326', first side wall 340' and/or second side wall 342', forms an opposing stacking support, generally designated as 360', about at least a portion of a perimeter of container 300' to facilitate stacking packaged container assemblies 355.

In one embodiment, packaged container assembly 355 includes a suitable cover member 365, such as an inverted U-shaped tray or other suitable tray, or a pad, that covers at least a portion of container 300 and/or container 300' to facilitate retaining container 300 positioned with respect to container 300'. In a particular embodiment, cover member 365 includes opposing side walls 366, 367 and/or opposing end walls 368, 369 coupled to a main panel 370 that are positioned about corresponding back walls 324, 324', top walls 326, 326', first side walls 340, 340' and/or second side walls 342, 342' of respective containers 300, 300' to retain container 300 positioned with respect to container 300'. Additionally or alternatively, containers 300, 300' are positioned within a suitable cover member 365 such that bottom wall 322 and bottom wall 322' are supported by main panel 370.

Containers 300, 300' are coupled to cover member 365 using a suitable coupling mechanism (not shown) including, without limitation, strapping, stretch banding and/or shrink film. It is apparent to those skilled in the art and guided by the teachings herein provided that any suitable coupling mechanism may be used to couple containers 300, 300'. In certain embodiments, the product is packaged in a primary package, such as a gable top carton or a flexible pouch, which does not have a necessary stacking strength to support stacking the primary packages. Such packaging of two or more containers 300, 300' in packaged container assembly 355 provides opposing stacking supports 360, 360' to facilitate stacking packaged container assemblies 355.

After packaged container assemblies 355 reach the merchandising destination, the coupling mechanism and cover member 365 are removed. Each container 300, 300' is positionable, such as placed on a shelf, with display area 150 visible to consumers to facilitate displaying the product contained within containers 300, 300'. In one embodiment, containers 300, 300' are positioned in a side-by side configuration, such that first side wall 340 is positioned near or contacting second side wall 342', as shown in FIG. 12. In an alternative embodiment, containers 300, 300' are positioned in a front-to-back configuration, such that back wall 324 is positioned near or contacting front wall 320', as shown in FIG. 13.

Figure 14:
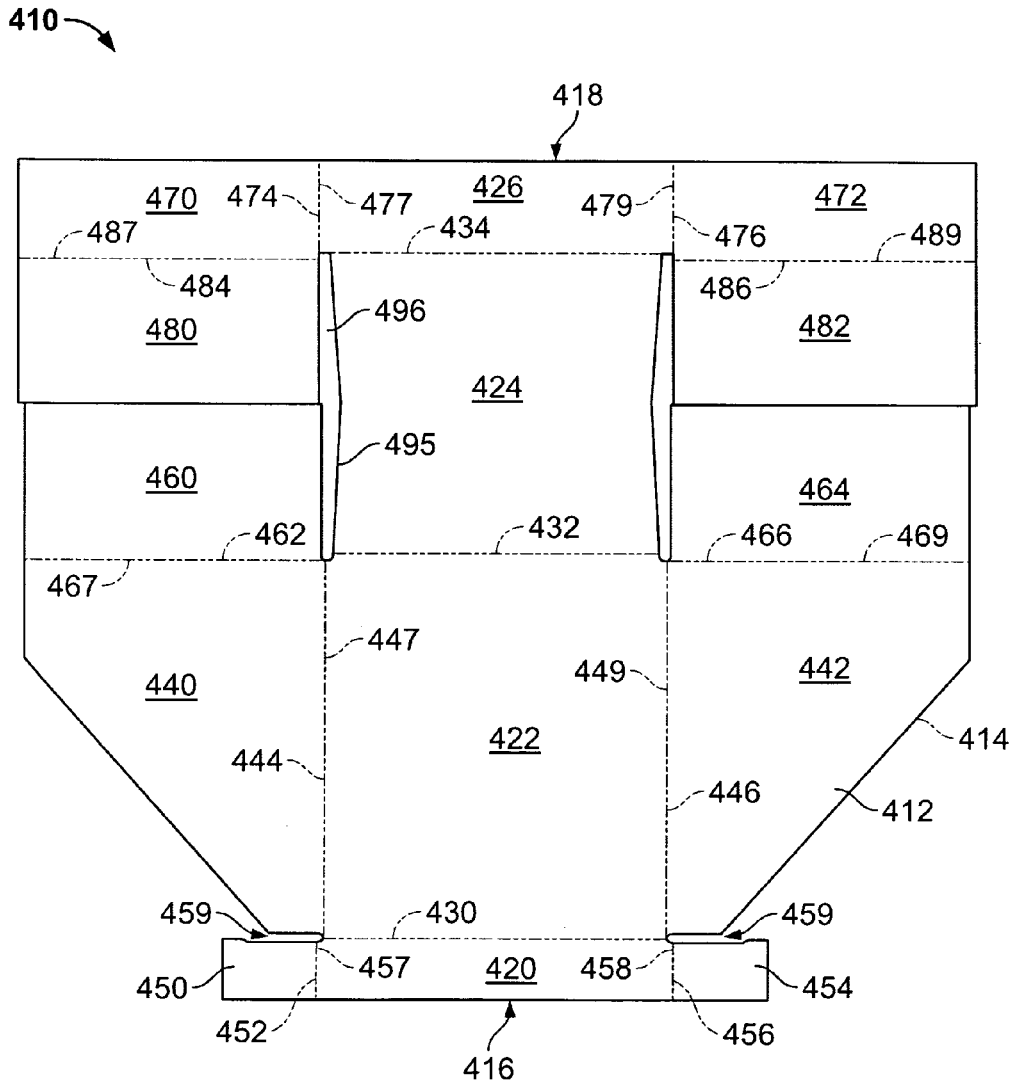
FIG. 14 is a top plan view of a blank of sheet material for constructing a container, according to one embodiment of this invention.
Figure 15:
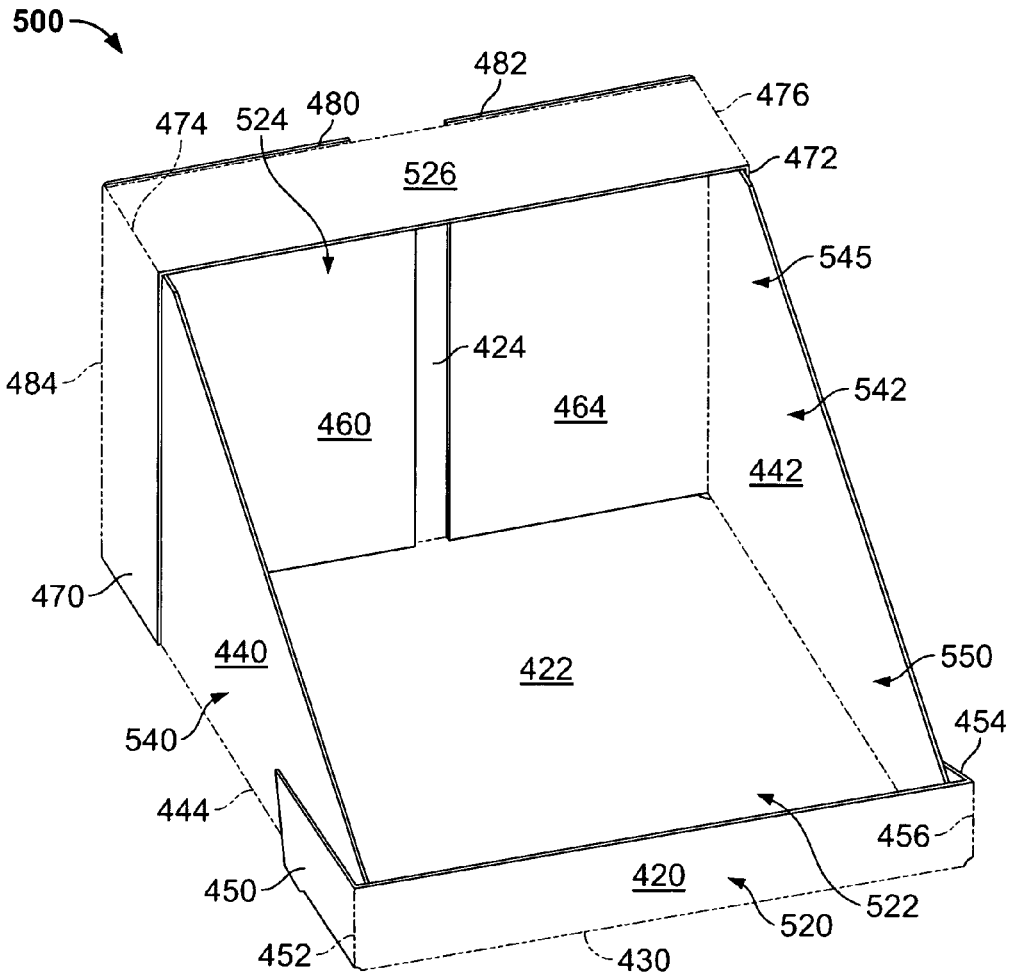
FIG. 15 is a perspective view of a container constructed from the blank shown in FIG. 14.

FIGS. 14 and 15 illustrate the construction or formation of one embodiment of a container. Specifically, FIG. 14 is a top plan view of one embodiment of a blank of sheet material 410. FIG. 15 is a perspective view of one embodiment of a container 500 formed from blank 410 shown in FIG. 14.

Referring to FIG. 14, blank 410 has a first or interior surface 412 and an opposing second or exterior surface 414. Further, blank 410 defines a leading edge 416 and an opposing trailing edge 418. Blank 410 has a corrugation direction generally perpendicular to a length of blank 410 defined between leading edge 416 and trailing edge 418. In one embodiment, blank 410 includes, from leading edge 416 to trailing edge 418, a front panel 420, a bottom panel 422, a back panel 424 and a top panel 426 coupled together along preformed, generally parallel, fold lines 430, 432 and 434, respectively. More specifically, bottom panel 422 extends from front panel 420 along respective fold line 430, back panel 424 extends from bottom panel 422 along respective fold line 432 and top panel 426 extends from back panel 424 along respective fold line 434. Fold lines 430, 432 and 434, as well as other fold lines described herein, may include any suitable line of weakening and/or line of separation known to those skilled in the art and guided by the teachings herein provided.

As shown in FIG. 14, in one embodiment a first inner side panel 440 and a second inner side panel 442 are coupled to bottom panel 422 along preformed, generally parallel, fold lines 444 and 446, respectively. Specifically, first inner side panel 440 extends from a first side edge 447 of bottom panel 422 along fold line 444. Second inner side panel 442 extends from an opposing second side edge 449 of bottom panel 422 along fold line 446. In this embodiment, a first front flap 450 is coupled to front panel 420 along preformed fold line 452 and a second front flap 454 is coupled to front panel 420 along preformed fold line 456. Specifically, first front flap 450 extends from a first side edge 457 of front panel 420 along fold line 452 and generally perpendicular to fold line 430. Second front flap 454 extends from an opposing second side edge 458 of front panel 420 along fold line 456 and generally perpendicular to fold line 430. In this embodiment, first front flap 450 is separated from first inner side panel 440 to at least partially define a space 459 between first front flap 450 and first inner side panel 440. Second front flap 454 is separated from second inner side panel 442 to at least partially define a space 459 between second front flap 454 and second inner side panel 442. Referring further to FIG. 14, side edge 457 of first front flap 450 and side edge 458 of second front flap 454 are generally parallel to and offset with respect to side edge 447 and side edge 449, respectively, to compensate for a thickness of first inner side panel 440 and second inner side panel 442, respectively, when container 500 is constructed from blank 410, as described in greater detail below.

A first inner back panel 460 is coupled to first inner side panel 440 along preformed fold line 462 and a second inner back panel 464 is coupled to second inner side panel 442 along preformed fold line 466. Specifically, first inner back panel 460 extends from a second side edge 467 of first inner side panel 440 along fold line 462 and generally perpendicular to first side edge 447 of bottom panel 422. Second inner back panel 464 extends from a second side edge 469 of second inner side panel 442 along fold line 466 and generally perpendicular to second side edge 449 of bottom panel 422. Referring further to FIG. 14, second side edge 467 of first inner back panel 460 and second side edge 469 of second inner back panel 464 is generally parallel to and offset with respect to fold line 432 to compensate for a thickness of first inner back panel 460 and second inner back panel 464, respectively, when container 500 is constructed from blank 410, as described in greater detail below.

As shown in FIG. 14, a first outer side panel 470 and a second outer side panel 472 are coupled to top panel 426 along preformed, generally parallel, fold lines 474 and 476, respectively. Specifically, first outer side panel 470 extends from a first side edge 477 of top panel 426 along fold line 474. Second outer side panel 472 extends from an opposing second side edge 479 of top panel 426 along fold line 476. A first outer back panel 480 is coupled to first outer side panel 470 and a second outer back panel 482 is coupled to second outer side panel 472. More specifically, first outer back panel 480 is coupled to first outer side panel 470 along preformed fold line 484 and second outer back panel 482 is coupled to second outer side panel 472 along preformed fold line 486. First outer back panel 480 extends from a first side edge 487 of first outer side panel 470 along fold line 484 and generally perpendicular to first side edge 477. Second outer back panel 482 extends from a first side edge 489 of second outer side panel 472 along fold line 486 and generally perpendicular to second side edge 479.

Referring further to FIG. 14, first side edge 487 of first outer side panel 470 and first side edge 489 of second outer side panel 472 are generally parallel to and offset with respect to fold line 434 to compensate for a thickness of back panel 424 when container 500 is constructed from blank 410, as described in greater detail below.

As shown in FIG. 14, a first side edge 495 of back panel 424 tapers inwardly from fold line 432 and from fold line 434 to converge at an apex. At fold line 434 side edge 495 is offset with respect to fold line 474 coupling first outer side panel 470 to top panel 426. As such, side edge 495 at least partially defines a void 496 between back panel 424, top panel 426, first outer side panel 470, first outer back panel 480, first inner back panel 460, first inner side panel 440 and/or bottom panel 422 of blank 410. Similarly, a second side edge 497 of back panel 424 tapers inwardly from fold line 432 and from fold line 434 to converge at an apex. At fold line 434 side edge 497 is offset with respect to fold line 476 coupling second outer side panel 472 to top panel 426. As such, side edge 497 at least partially defines a void 498 between back panel 424, top panel 426, second outer side panel 472, second outer back panel 482, second inner back panel 464, second inner side panel 442 and/or bottom panel 422.

FIG. 15 shows container 500 constructed from blank 410. In one embodiment, container 500 is constructed from blank 410 by folding blank 410 about the fold lines. In one embodiment, an adhesive material is applied to portions of blank 410 to secure selected portions of container 500 together. Container 500 includes a front wall 520, a bottom wall 522, a back wall 524, a top wall 526, a first side wall 540 and an opposing second side wall 542. More specifically, front wall 520 includes front panel 420. First front flap 450 couples a first side of front wall 520 to first side wall 540 and second front flap 454 couples a second side of front wall 520 to second side wall 454. Back wall 524 includes inner back panels 460, 464 coupled to interior surface 412 of back panel 424 and outer back panels 480, 482 coupled to exterior surface 414 of back panel 424. First side wall 540 includes first inner side panel 440, first front flap 450 and first outer side panel 470 coupled to exterior surface 414 of first inner side panel 440. Second side wall 542 includes second inner side panel 442, second front flap 454 and second outer side panel 472 coupled to exterior surface 414 of second inner side panel 442. Container 500 is constructed to define a cavity 545. As shown in FIG. 15, front wall 520 defines a display area 550 for facilitating displaying product contained within container 500. In one embodiment, at least a portion of display area 550 is further defined by first side wall 540, second side wall 542 and/or top wall 526.

Each constructed container 500 is loaded with a product and a plurality of loaded containers 500 are prepared for shipping to a merchandising destination. In one embodiment, for example, two loaded containers 500 are coupled together and packaged for shipping to the merchandising destination in the form of a packaged container assembly. In this embodiment, individual containers 500 are positioned such that front wall 520 of a first container 500 faces and contacts a front wall 520 of a second container 500. With front wall 520 of first container 500 contacting front wall 520 of second container 500, back wall 524, alone or in combination with top wall 526, first side wall 540 and/or second side wall 542 of each container 500, provides an opposing stacking support about at least a portion of a perimeter of the coupled containers, as described in greater detail above in reference to FIGS. 11-13.

In one embodiment, the packaged container assembly includes a suitable cover member, such as an inverted U-shaped tray or other suitable tray, or a pad, which covers at least a portion of containers 500 to facilitate retaining containers 500 positioned with respect to each other. In a particular embodiment, the cover member includes opposing side walls and/or opposing end walls that are positioned about corresponding back wall 524, top wall 526, first side wall 540 and/or second side wall 542 of each container 500 to retain containers 500 properly positioned. Containers 500 are coupled to the cover member using a suitable coupling mechanism including, without limitation, strapping, stretch banding and/or shrink film. Such packaging of two or more containers 500 in the form of a packaged container assembly facilitates stacking containers 500 containing product packaged in a primary package, such as a gable top carton or a flexible pouch, that do not have a necessary stacking strength to support stacking such primary packages. After the packaged container assemblies reach the merchandising destination, the coupling mechanism and the cover member are removed. Each container 500 is positionable, such as placed on a shelf, with display area 550 visible to consumers to facilitate displaying the product contained within container 500.

Figure 16:
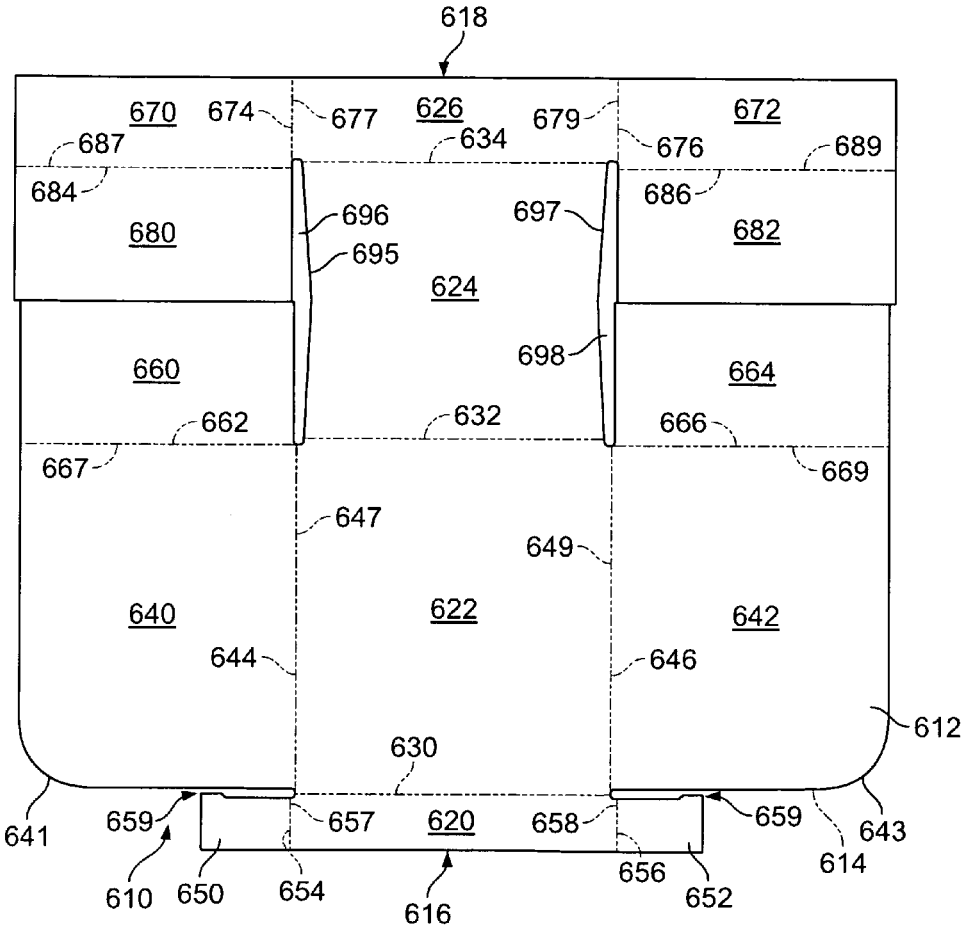
FIG. 16 is a top plan view of a blank of sheet material for constructing a container, according to one embodiment of this invention.
Figure 17:
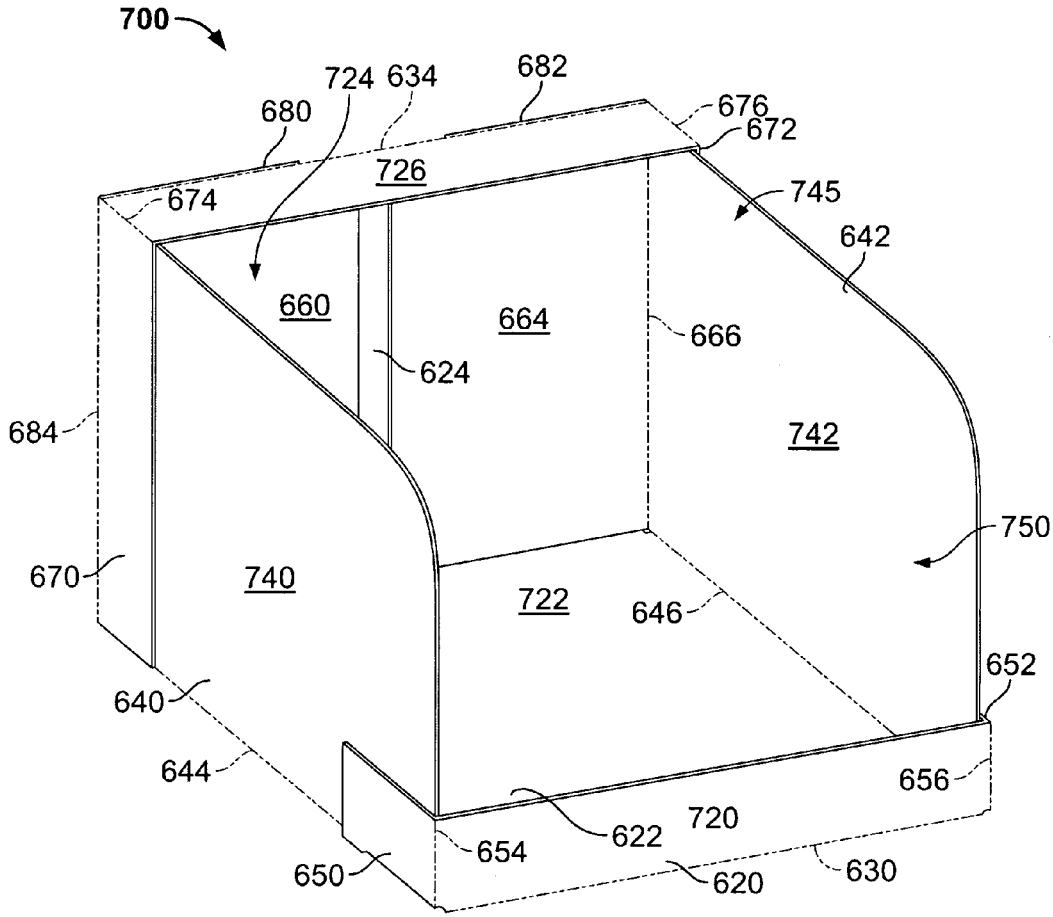
FIG. 17 is a perspective view of a container constructed from the blank shown in FIG. 16.

FIGS. 16 and 17 illustrate the construction or formation of one embodiment of a container. Specifically, FIG. 16 is a top plan view of one embodiment of a blank of sheet material 610. FIG. 17 is a perspective view of one embodiment of a container 700 formed from blank 610 shown in FIG. 16.

Referring to FIG. 16, blank 610 has a first or interior surface 612 and an opposing second or exterior surface 614. Further, blank 610 defines a leading edge 616 and an opposing trailing edge 618. Blank 610 has a corrugation direction generally perpendicular to a length of blank 610 defined between leading edge 616 and trailing edge 618. In one embodiment, blank 610 includes, from leading edge 616 to trailing edge 618, a front panel 620, a bottom panel 622, a back panel 624 and a top panel 626 coupled together along preformed, generally parallel, fold lines 630, 632 and 634, respectively. More specifically, bottom panel 622 extends from front panel 620 along respective fold line 630, back panel 624 extends from bottom panel 622 along respective fold line 632 and top panel 626 extends from back panel 624 along respective fold line 634. Fold lines 630, 632 and 634, as well as other fold lines described herein, may include any suitable line of weakening and/or line of separation known to those skilled in the art and guided by the teachings herein provided.

As shown in FIG. 16, in one embodiment a first inner side panel 640 having an arcuate edge portion 641 and a second inner side panel 642 having an arcuate edge portion 643 are coupled to bottom panel 622 along preformed, generally parallel, fold lines 644 and 646, respectively. Specifically, first inner side panel 640 extends from a first side edge 647 of bottom panel 622 along fold line 644. Second inner side panel 642 extends from an opposing second side edge 649 of bottom panel 622 along fold line 646. In this embodiment, a first front flap 650 and an opposing second front flap 652 are coupled to front panel 620 along preformed fold line 654 and preformed fold line 656, respectively. Specifically, first front flap 650 extends from a first side edge 657 of front panel 620 along fold line 654 and generally perpendicular to fold line 630. Second front flap 652 extends from opposing side edge 658 of front panel 620 along fold line 656 and generally perpendicular to fold line 630. In this embodiment, first front flap 650 is separated from first inner side panel 640 to at least partially define a space 659 between first front flap 650 and first inner side panel 640. Second front flap 652 is separated from second inner side panel 642 to at least partially define a space 659 between second front flap 652 and second inner side panel 642. Referring further to FIG. 16, first side edge 657 of first front flap 650 and first side edge 658 of second front flap 652 are generally parallel to and offset with respect to side edge 647 and side edge 649, respectively, to compensate for a thickness of first inner side panel 640 and second inner side panel 642, respectively, when container 700 is constructed from blank 610, as described in greater detail below.

A first inner back panel 660 is coupled to first inner side panel 640 along preformed fold line 662 and a second inner back panel 664 is coupled to second inner side panel 642 along preformed fold line 666. Specifically, first inner back panel 660 extends from a second side edge 667 of first inner side panel 640 along fold line 662 and generally perpendicular to first side edge 647 of bottom panel 622. Second inner back panel 664 extends from a second side edge 669 of second inner side panel 642 along fold line 666 and generally perpendicular to second side edge 649 of bottom panel 622. Referring further to FIG. 16, second side edge 667 of first inner back panel 660 and second side edge 669 of second inner side panel 664 is generally parallel to and offset with respect to fold line 632 to compensate for a thickness of first inner back panel 660 and second inner back panel 664, respectively, when container 700 is constructed from blank 610, as described in greater detail below.

As shown in FIG. 16, a first outer side panel 670 and a second outer side panel 672 are coupled to top panel 626 along preformed, generally parallel, fold lines 674 and 676, respectively. Specifically, first outer side panel 670 extends from a first side edge 677 of top panel 626 along fold line 674. Second outer side panel 672 extends from an opposing second side edge 679 of top panel 626 along fold line 676. A first outer back panel 680 is coupled to first outer side panel 670 and a second outer back panel 682 is coupled to second outer side panel 672. More specifically, first outer back panel 680 is coupled to first outer side panel 670 along preformed fold line 684 and second outer back panel 682 is coupled to second outer side panel 672 along preformed fold line 686. First outer back panel 680 extends from a first side edge 687 of first outer side panel 670 along fold line 684 and generally perpendicular to first side edge 677. Second outer back panel 682 extends from a first side edge 689 of second outer side panel 672 along fold line 686 and generally perpendicular to second side edge 679.

Referring further to FIG. 16, first side edge 687 of first outer side panel 670 and first side edge 689 of second outer side panel 672 are generally parallel to and offset with respect to fold line 634 to compensate for a thickness of back panel 624 when container 700 is constructed from blank 610, as described in greater detail below.

As shown in FIG. 16, a first side edge 695 of back panel 624 tapers inwardly from fold line 632 and from fold line 634 to converge at an apex. At fold line 632, side edge 695 is offset with respect to fold line 644 coupling first inner side panel 640 to bottom panel 622 and, at fold line 634, side edge 695 is offset with respect to fold line 674 coupling first outer side panel 670 to top panel 626. As such, side edge 695 at least partially defines a void 696 between back panel 624, top panel 626, first outer side panel 670, first outer back panel 680, first inner back panel 660, first inner side panel 640 and/or bottom panel 622. Similarly, a second side edge 697 of back panel 624 tapers inwardly from fold line 632 and from fold line 634 to converge at an apex. At fold line 632, side edge 697 is offset with respect to fold line 646 coupling second inner side panel 642 to bottom panel 622 and, at fold line 634, side edge 697 is offset with respect to fold line 676 coupling second outer side panel 672 to top panel 626. As such, side edge 697 at least partially defines a void 698 between back panel 624, top panel 626, second outer side panel 672, second outer back panel 682, second inner back panel 664, second inner side panel 642 and/or bottom panel 622.

FIG. 17 shows container 700 constructed from blank 610. In one embodiment, container 700 is constructed from blank 610 by folding blank 610 about the fold lines. In one embodiment, an adhesive material is applied to portions of blank 610 to secure selected portions of container 700 together. Container 700 includes a front wall 720, a bottom wall 722, a back wall 724, a top wall 726, a first side wall 740 and an opposing second side wall 742. More specifically, front wall 720 includes front panel 620. First front flap 650 couples a first side of front wall 720 to first side wall 740 and second front flap 652 couples a second side of front wall 720 to second side wall 742. Back wall 724 includes inner back panels 660, 664 coupled to interior surface 612 of back panel 624 and outer back panels 680, 682 coupled to exterior surface 614 of back panel 624. First side wall 740 includes first inner side panel 640, first front flap 650 and first outer side panel 670 coupled to exterior surface 614 of first inner side panel 640. Second side wall 742 includes second inner side panel 642, second front flap 652 and second outer side panel 672 coupled to exterior surface 614 of second inner side panel 642. Container 700 is constructed to define a cavity 745. As shown in FIG. 17, front wall 720 defines a display area 750 for facilitating displaying product contained within container 700. In one embodiment, at least a portion of display area 750 is further defined by first side wall 740, second side wall 742 and/or top wall 726.

Each constructed container 700 is loaded with a product and a plurality of loaded containers 700 are prepared for shipping to a merchandising destination. In one embodiment, for example, two loaded containers 700 are coupled together and packaged for shipping to the merchandising destination in the form of a packaged container assembly. In this embodiment, individual containers 700 are positioned such that front wall 720 of a first container 700 faces and contacts a front wall 720 of a second container 700. With front wall 720 of first container 700 contacting front wall 720 of second container 700, back wall 724, alone or in combination with top wall 726, first side wall 740 and/or second side wall 742 of each container 700, provides an opposing stacking support about at least a portion of a perimeter of the coupled containers, as described in greater detail above in reference to FIGS. 11-13.

In one embodiment, the packaged container assembly includes a suitable cover member, such as an inverted U-shaped tray or other suitable tray, or a pad, which covers at least a portion of containers 700 to facilitate retaining containers 700 positioned with respect to each other. In a particular embodiment, the cover member includes opposing side walls and/or opposing end walls that are positioned about corresponding back wall 724, top wall 726, first side wall 740 and/or second side wall 742 of each container 700 to retain containers 700 properly positioned. Containers 700 are coupled to the cover member using a suitable coupling mechanism including, without limitation, strapping, stretch banding and/or shrink film. Such packaging of two or more containers 700 in the form of a packaged container assembly facilitates stacking containers 700 containing product packaged in a primary package, such as a gable top carton or a flexible pouch, that do not have a necessary stacking strength to support stacking such primary packages. After the packaged container assemblies reach the merchandising destination, the coupling mechanism and the cover member are removed. Each container 700 is positionable, such as placed on a shelf, with display area 750 visible to consumers to facilitate displaying the product contained within container 700.

Figure 18:
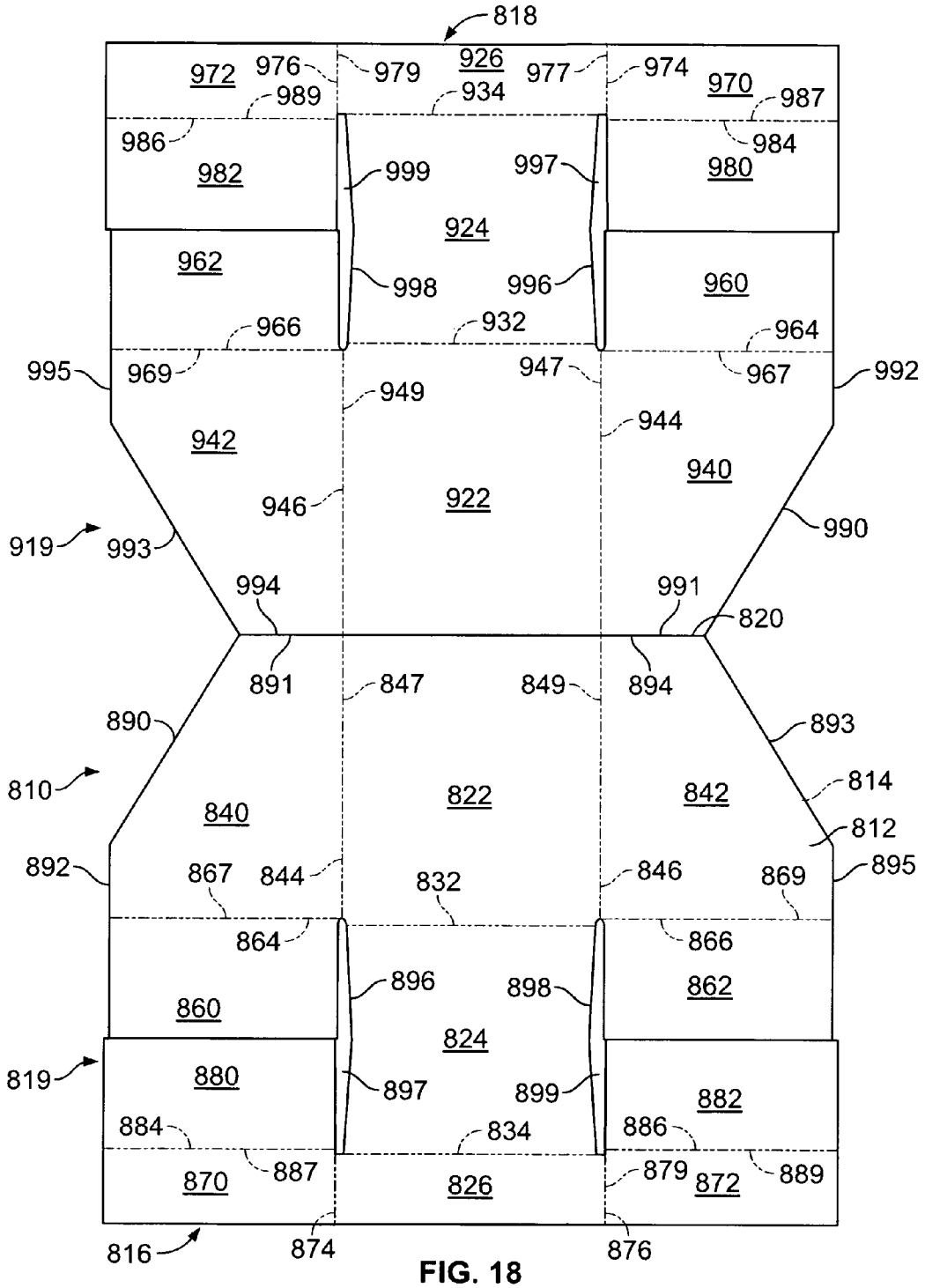
FIG. 18 is a top plan view of a blank of sheet material for constructing a container, according to one embodiment of this invention.
Figure 19:
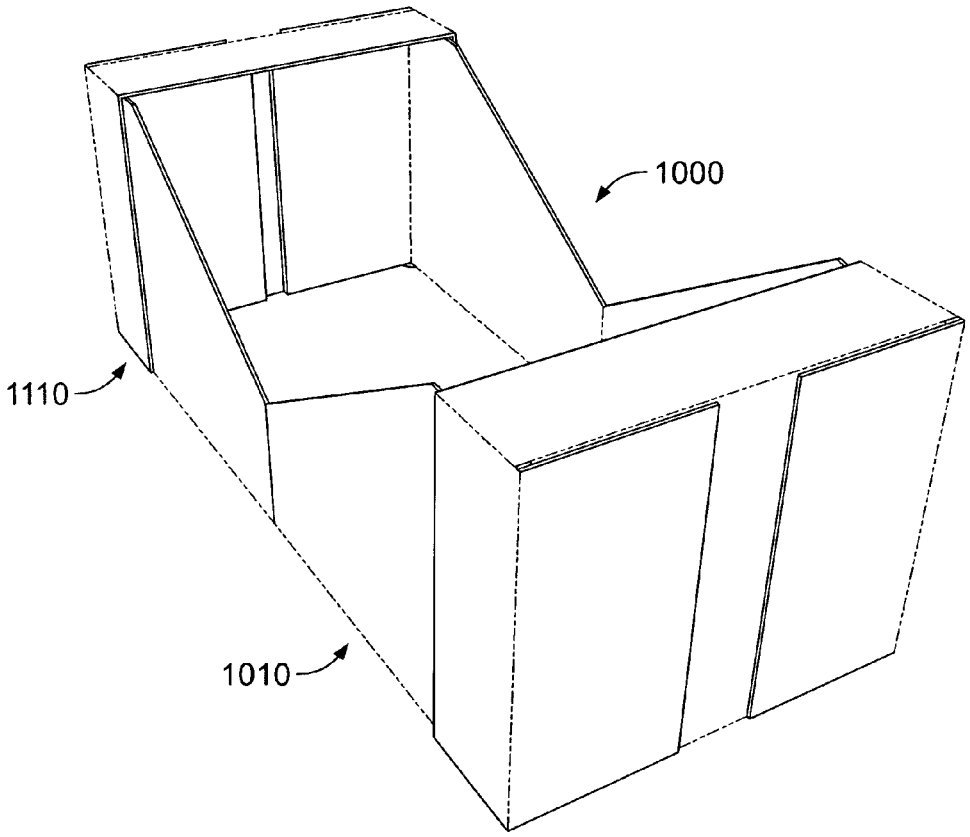
FIG. 19 is a perspective view of a twin-tray assembly constructed from the blank shown in FIG. 18.
Figure 20:
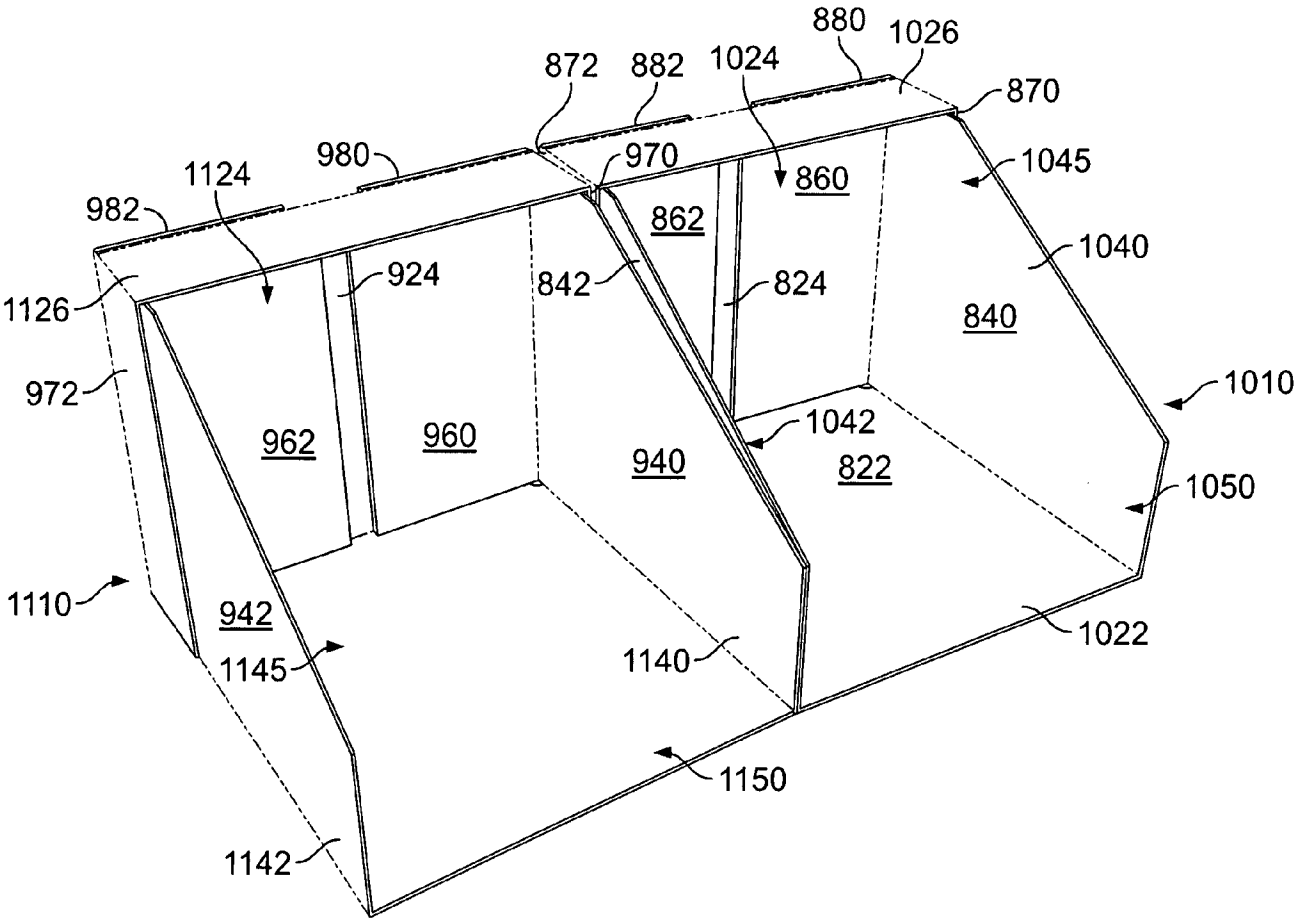
FIG. 20 is a perspective view of two display trays constructed from the twin-tray assembly shown in FIG. 19.

FIGS. 18-20 illustrate the construction or formation of one embodiment of two open-front display trays. Specifically, FIG. 18 is a top plan view of one embodiment of a blank of sheet material 810. FIG. 19 is a perspective view of one embodiment of a machine formed twin-tray assembly 1000 formed from blank 810 shown in FIG. 18. FIG. 20 is a perspective view of two open-front display trays 1010, 1110 formed from twin-tray assembly 1000 shown in FIG. 19.

Referring to FIG. 18, blank 810 defines a longitudinal centerline 811 and has a first or interior surface 812 and an opposing second or exterior surface 814. Further, blank 810 defines a leading edge 816 and an opposing trailing edge 818. Blank 810 has a corrugation direction generally perpendicular to a length of blank 10 defined between leading edge 816 and trailing edge 818. In one embodiment, blank 810 includes a first tray portion 819 and a substantially similar second tray portion 919 coupled together along coupling line 820. In one embodiment, coupling line 820 includes a tearable line of separation. In an alternative embodiment, coupling line 820 includes a line of weakening, as described in greater detail below.

As shown in FIG. 18, first tray portion 819 includes a bottom panel 822, a back panel 824 and a top panel 826 coupled together along preformed, generally parallel, fold lines 832 and 834, respectively. More specifically, back panel 824 extends from bottom panel 822 along respective fold line 832 and top panel 826 extends from back panel 824 along respective fold line 834. Fold lines 832 and 834, as well as other fold lines described herein, may include any suitable line of weakening and/or line of separation known to those skilled in the art and guided by the teachings herein provided.

In one embodiment, a first inner side panel 840 and a second inner side panel 842 are coupled to bottom panel 822 along preformed, generally parallel, fold lines 844 and 846, respectively. Specifically, first inner side panel 840 extends from a first side edge 847 of bottom panel 822 along fold line 844. Second inner side panel 842 extends from an opposing second side edge 849 of bottom panel 822 along fold line 846.

A first inner back panel 860 is coupled to first inner side panel 840 along preformed fold line 864 and a second inner back panel 862 is coupled to second inner side panel 842 along preformed fold line 866. Specifically, first inner back panel 860 extends from a side edge 867 of first inner side panel 840 along fold line 864 and generally perpendicular to first side edge 847. Second inner back panel 862 extends from a side edge 869 of second inner side panel 842 along fold line 866 and generally perpendicular to side edge 849. Referring further to FIG. 18, side edge 867 of first inner back panel 860 and side edge 869 of second inner back panel 862 are generally parallel to and offset with respect to fold line 832 to compensate for a thickness of first inner back panel 860 and second inner back panel 862, respectively, when twin-tray assembly 1000 is constructed from blank 810, as described in greater detail below.

As shown in FIG. 18, a first outer side panel 870 and a second outer side panel 872 are coupled to top panel 826 along preformed, generally parallel, fold lines 874 and 876, respectively. Specifically, first outer side panel 870 extends from a first side edge 877 of top panel 826 along fold line 874. Second outer side panel 872 extends from an opposing second side edge 879 of top panel 826 along fold line 876. A first outer back panel 880 is coupled to first outer side panel 870 along preformed fold line 884 and a second outer back panel 882 is coupled to second outer side panel 872 along preformed fold line 886. Specifically, first outer back panel 880 extends from a first side edge 887 of first outer side panel 870 along fold line 884 and generally perpendicular to first side edge 877. Second outer back panel 882 extends from a first side edge 889 of second outer side panel 872 along fold line 886 and generally perpendicular to second side edge 879.

Referring further to FIG. 18, first side edge 887 of first outer side panel 870 and first side edge 889 of second outer side panel 872 are generally parallel to and offset with respect to fold line 834 to compensate for a thickness of back panel 824 when twin-tray assembly 1000 is constructed from blank 810, as described in greater detail below. Further, in one embodiment an angled edge 890 of first inner side panel 840 extends outwardly with respect to a longitudinal centerline of blank 810 from a front or leading edge 891 of first inner side panel 840 defined along a portion of coupling line 820 to a top or trailing edge 892 of first inner side panel 840. Similarly, an angled edge 893 of second inner side panel 842 extends outwardly with respect to a longitudinal centerline of blank 810 from a front or leading edge 894 of second inner side panel 842 defined along a portion of coupling line 820 to a top or trailing edge 895 of second inner side panel 842.

As shown in FIG. 18, a first side edge 896 of back panel 824 tapers inwardly from fold line 832 and fold line 834 to converge at an apex. At fold line 834 side edge 896 is offset with respect to fold line 874 coupling first outer side panel 870 to top panel 826. As such, side edge 896 at least partially defines a void 897 between back panel 824, top panel 826, first outer side panel 870, first outer back panel 880, first inner back panel 860, first inner side panel 840 and/or bottom panel 822. Similarly, a second side edge 898 of back panel 824 tapers inwardly from fold line 832 and fold line 834 to converge at an apex. At fold line 834 side edge 898 is offset with respect to fold line 876 coupling second outer side panel 872 to top panel 826. As such, side edge 898 at least partially defines a void 899 between back panel 824, top panel 826, second outer side panel 872, second outer back panel 882, second inner back panel 862, second inner side panel 842 and/or bottom panel 822.

As shown in FIG. 18, second tray portion 919 includes a bottom panel 922, a back panel 924 and a top panel 926 coupled together along preformed, generally parallel, fold lines 932 and 934, respectively. More specifically, back panel 924 extends from bottom panel 922 along respective fold line 932 and top panel 926 extends from back panel 924 along respective fold line 934. Fold lines 932 and 934, as well as other fold lines described herein, may include any suitable line of weakening and/or line of separation known to those skilled in the art and guided by the teachings herein provided.

In one embodiment, a first inner side panel 940 and a second inner side panel 942 are coupled to bottom panel 922 along preformed, generally parallel, fold lines 944 and 946, respectively. Specifically, first inner side panel 940 extends from a first side edge 947 of bottom panel 922 along fold line 944. Second inner side panel 942 extends from an opposing second side edge 949 of bottom panel 922 along fold line 946.

A first inner back panel 960 is coupled to first inner side panel 940 along preformed fold line 964 and a second inner back panel 962 is coupled to second inner side panel 942 along preformed fold line 966. Specifically, first inner back panel 960 extends from a side edge 967 of first inner side panel 940 along fold line 964 and generally perpendicular to first side edge 947. Second inner back panel 962 extends from a side edge 969 of second inner side panel 942 along fold line 966 and generally perpendicular to side edge 949. Referring further to FIG. 18, side edge 967 of first inner back panel 960 and side edge 969 of second inner back panel 962 are generally parallel to and offset with respect to fold line 932 to compensate for a thickness of first inner back panel 960 and second inner back panel 962, respectively, when twin-tray assembly 1000 is constructed from blank 910, as described in greater detail below.

As shown in FIG. 18, a first outer side panel 970 and a second outer side panel 972 are coupled to top panel 926 along preformed, generally parallel, fold lines 974 and 976, respectively. Specifically, first outer side panel 970 extends from a first side edge 977 of top panel 926 along fold line 974. Second outer side panel 972 extends from an opposing second side edge 979 of top panel 926 along fold line 976. A first outer back panel 980 is coupled to first outer side panel 970 along preformed fold line 984 and a second outer back panel 982 is coupled to second outer side panel 972 along preformed fold line 986. Specifically, first outer back panel 980 extends from a first side edge 987 of first outer side panel 970 along fold line 984 and generally perpendicular to first side edge 977. Second outer back panel 982 extends from a first side edge 989 of second outer side panel 972 along fold line 986 and generally perpendicular to second side edge 979.

Referring further to FIG. 18, first side edge 987 of first outer side panel 970 and first side edge 989 of second outer side panel 972 are generally parallel to and offset with respect to fold line 934 to compensate for a thickness of back panel 924 when twin-tray assembly 1000 is constructed from blank 910, as described in greater detail below. Further, in one embodiment an angled edge 990 of first inner side panel 940 extends outwardly with respect to a longitudinal centerline of blank 910 from a front edge 991 of first inner side panel 940 defined along a portion of line of separation 920 to a top edge 992 of first inner side panel 940. Similarly, an angled edge 993 of second inner side panel 942 extends outwardly with respect to a longitudinal centerline of blank 910 from a front edge 994 of second inner side panel 942 defined along a portion of line of separation 920 to a top edge 995 of second inner side panel 942.

As shown in FIG. 18, a first side edge 996 of back panel 924 tapers inwardly from fold line 932 and fold line 934 to converge at an apex. At fold line 934, side edge 996 is offset with respect to fold line 974 coupling first outer side panel 970 to top panel 926. As such, side edge 996 at least partially defines a void 997 between back panel 924, top panel 926, first outer side panel 970, first outer back panel 980, first inner back panel 960, first inner side panel 940 and/or bottom panel 922. Similarly, a second side edge 998 of back panel 924 tapers inwardly from fold line 932 and fold line 934 to converge at an apex. At fold line 934, side edge 998 is offset with respect to fold line 976 coupling second outer side panel 972 to top panel 926. As such, side edge 998 at least partially defines a void 999 between back panel 924, top panel 926, second outer side panel 972, second outer back panel 982, second inner back panel 962, second inner side panel 942 and/or bottom panel 922.

FIG. 19 shows a twin-tray assembly 1000 constructed from blank 810. In one embodiment, twin-tray assembly 1000 is constructed from blank 810 by folding blank 810 about the fold lines. In one embodiment, an adhesive material is applied to portions of blank 810 to secure selected portions of twin-tray assembly 1000 together. Twin-tray assembly 1000 includes a first display tray 1010 constructed from first tray portion 819 and a second display tray 1110 constructed from second tray portion 919. In one embodiment, coupling line 820 includes a tearable line of separation. It is apparent to those skilled in the art and guided by the teachings herein provided that coupling line 820 may include any suitable line of separation including at least one score line and/or at least one perforated line. Referring further to FIG. 20, in this embodiment, a force is applied to twin-tray assembly 1000 along coupling line 820 to separate first tray portion 819 from second tray portion 919. In an alternative embodiment, coupling line 820 includes a suitable line of weakening to allow first display tray 1010 to be folded with respect to second display tray 1110 along coupling line 820.

As shown in FIG. 20, first display tray 1010 includes a bottom wall 1022, a back wall 1024, a top wall 1026, a first side wall 1040 and an opposing second side wall 1042. More specifically, back wall 1024 includes inner back panels 860, 862 coupled to interior surface 12 of back panel 824 and outer back panels 880, 882 coupled to exterior surface 14 of back panel 824. First side wall 1040 includes first inner side panel 840 and first outer side panel 870 coupled to exterior surface 14 of first inner side panel 840. Second side wall 1042 includes second inner side panel 842 and second outer side panel 872 coupled to exterior surface 14 of second inner side panel 842. First display tray 1010 is constructed to define a cavity 1045. As shown in FIG. 20, a display area 1050 is defined within first display tray 1010 for facilitating displaying product contained within display tray 1010. In one embodiment, at least a portion of display area 1050 is further defined by first side wall 1040, second side wall 1042 and/or top wall 1026.

In this embodiment, second display tray 1110 includes a bottom wall 1122, a back wall 1124, a top wall 1126, a first side wall 1140 and an opposing second side wall 1142. More specifically, back wall 1124 includes inner back panels 960, 962 coupled to interior surface 12 of back panel 924 and outer back panels 980, 982 coupled to exterior surface 14 of back panel 924. First side wall 1140 includes first inner side panel 940 and first outer side panel 970 coupled to exterior surface 14 of first inner side panel 940. In a particular embodiment, first side wall 1140 of second display tray 1110 is coupled to second side wall 1042 of first display tray 1010 along a portion of coupling line 820. Second side wall 1142 includes second inner side panel 942 and second outer side panel 972 coupled to exterior surface 14 of second inner side panel 942. Second display tray 1110 is constructed to define a cavity 1145. As shown in FIG. 20, a display area 1150 is defined within second display tray 1110 for facilitating displaying product contained within display tray 1110. In one embodiment, at least a portion of display area 1150 is further defined by first side wall 1140, second side wall 1142 and/or top wall 1126.

Referring to FIGS. 18-20, in one embodiment, first display tray 1010 and second display tray 1110 are formed from twin-tray assembly 1000, which is constructed from blank 810 using a machine (not shown). In this embodiment, the machine is configured to apply a suitable adhesive material, such as a suitable glue material, to selected or desired portions of blank 810 to secure selected components, such as selected flaps and/or panels, together. For example, to form back wall 1024, an adhesive material may be applied to an outer surface of inner back panels 860, 862 and/or an inner surface of back panel 824 to adhesively couple inner back panels 860, 862 to back panel 824, respectively, and/or to an inner surface of outer back panels 880, 882 and/or an outer surface of back panel 824 to adhesively couple outer back panels 880, 882 to back panel 824. Additionally, an adhesive material may be applied to an outer surface of inner side panels 840, 842 and/or to an inner surface of outer side panels 870, 872 to adhesively couple inner side panels 840, 842 to outer side panels 870, 872, respectively, to form side wall 1040, 1042, respectively.

Similarly, to form back wall 1124, an adhesive material may be applied to an outer surface of inner back panels 960, 962 and/or an inner surface of back panel 924 to adhesively couple inner back panels 960, 962 to back panel 924, respectively, and/or to an inner surface of outer back panels 980, 982 and/or an outer surface of back panel 924 to adhesively couple outer back panels 980, 982 to back panel 924. Additionally, an adhesive material may be applied to an outer surface of inner side panels 940, 942 and/or to an inner surface of outer side panels 970, 972 to adhesively couple inner side panels 940, 942 to outer side panels 970, 972, respectively, to form side wall 1140, 1142, respectively.

Referring further to FIGS. 18-20, in one embodiment a method is provided for constructing twin-tray assembly 1000 from blank 810 and further forming first display tray 1010 and second display tray 1110 from twin-tray assembly 1000. A blank 810, as shown in FIG. 18, including a first tray portion 819 and a second display portion 919 is provided to construct twin-tray assembly 1000 either manually or using a suitable machine (not shown) known to those skilled in the art and guided by the teachings herein provided. Referring to FIGS. 18 and 19, first inner side panel 840 is folded along fold line 844 with respect to bottom panel 822. First inner back panel 860 is folded along fold line 864 with respect first inner side panel 840 towards bottom panel 822. Similarly, second inner side panel 842 is folded along fold line 846 with respect to bottom panel 822. Second inner back panel 862 is folded along fold line 866 with respect second inner side panel 842 towards bottom panel 822. Additionally, first inner side panel 940 is folded along fold line 944 with respect to bottom panel 922. First inner back panel 960 is folded along fold line 964 with respect first inner side panel 940 towards bottom panel 922. Similarly, second inner side panel 942 is folded along fold line 946 with respect to bottom panel 922. Second inner back panel 962 is folded along fold line 966 with respect second inner side panel 942 towards bottom panel 922.

With first inner side panel 840 and second inner side panel 842 folded with respect to bottom panel 822 and first inner side panel 940 and second inner side panel 942 folded with respect to bottom panel 922, back panel 824 is folded along fold line 832 with respect to bottom panel 822 and coupled to first inner back panel 860 and second inner back panel 862 using a suitable coupler, such as an adhesive material, to partially form back wall 1024. Back panel 924 is folded along fold line 932 with respect to bottom panel 922 and coupled to first inner back panel 960 and second inner back panel 962 using a suitable coupler, such as an adhesive material, to partially form back wall 1124. Top panel 826 is then folded along fold line 834 with respect to back panel 824 to form top wall 1026 and top panel 926 is folded along fold line 934 with respect to back panel 924 to form top wall 1126.

First outer side panel 870 is folded along fold line 874 with respect to top panel 826 towards first inner side panel 840 and coupled to first inner side panel 840 using a suitable coupler, such as an adhesive material, to form first side wall 1040. Second outer side panel 872 is folded along fold line 876 with respect to top panel 826 towards second inner side panel 842 and coupled to second inner side panel 842 using a suitable coupler, such as an adhesive material, to form second side wall 1042. First outer side panel 970 is folded along fold line 974 with respect to top panel 926 towards first inner side panel 940 and coupled to first inner side panel 940 using a suitable coupler, such as an adhesive material, to form first side wall 1140. Second outer side panel 972 is folded along fold line 976 with respect to top panel 926 towards second inner side panel 942 and coupled to second inner side panel 942 using a suitable coupler, such as an adhesive material, to form second side wall 1142.

First outer back panel 880 is folded along fold line 884 with respect to first outer side panel 870 towards exterior surface 14 of back panel 824. First outer back panel 880 is coupled to back panel 824 using a suitable coupler, such as an adhesive material. Second outer back panel 882 is folded along fold line 886 with respect to second outer panel 872 towards exterior surface 14 of back panel 824. Second outer back panel 882 is coupled to back panel 824 using a suitable coupler, such as an adhesive material, to form back wall 1024. First outer back panel 980 is folded along fold line 984 with respect to first outer side panel 970 towards exterior surface 14 of back panel 924. First outer back panel 980 is coupled to back panel 924 using a suitable coupler, such as an adhesive material. Second outer back panel 982 is folded along fold line 986 with respect to second outer panel 972 towards exterior surface 14 of back panel 924. Second outer back panel 982 is coupled to back panel 924 using a suitable coupler, such as an adhesive material, to form back wall 1124.

With twin-tray assembly 1000 constructed, product is positioned within first tray portion 819 and second tray portion 919 and prepared for shipping. In one embodiment, the product is positioned within twin-tray assembly 1000 with respect to bottom wall 1022 and bottom wall 1122 to prevent or limit shifting of product within the individual product packaging. Back wall 1024 and back wall 1124 provide sufficient strength to twin-tray assembly 1000 for facilitating stacking a plurality of twin-tray assemblies 1000 for shipping.

At the merchandising destination or point of sale site, twin-tray assembly 1000 is reconfigured to provide first display tray 1010 and second display tray 1110. In one embodiment, coupling line 820 includes a tearable line of separation, as described above. At least a portion of coupling line 820 is torn to separate first inner side panel 840 from second inner side panel 942 and to separate bottom panel 822 from bottom panel 922. Second display tray 1110 is moved with respect to first display tray 1010 to position first display tray 1010 and second display tray 1110 in a display configuration. In a particular embodiment, second inner side panel 842 is folded along coupling line 820 with respect to first inner side panel 940 such that the outer surface of second inner side panel 842 contacts or approaches the outer surface of first inner side panel 940, as shown in FIG. 20. In an alternative particular embodiment, coupling line 820 is torn to separate second inner side panel 842 from first inner side panel 940. In the display configuration, first display tray 1010 and second display tray 1110 define a viewable display area 1050, 1150, respectively, for displaying the product positioned within cavity 1045, 1145, respectively.

In an alternative embodiment, coupling line 820 includes a foldable line of weakening, such as a suitable fold line. In this alternative embodiment, a force is applied to twin-tray assembly 1000 along the line of weakening to move second display tray 1110 with respect to first display tray 1010 to position first display tray 1010 and second display tray 1110 in a display configuration. In a particular embodiment, first tray portion 819 is folded with respect to second tray portion 919 such that the outer surface of bottom wall 1022 contacts or approaches the outer surface of bottom wall 1122 with first display tray 1010 and second display tray 1110 in the display configuration. In the display configuration, back wall 1024 and back wall 1124 are each positioned on a support surface, such as a shelf.

Figure 21:
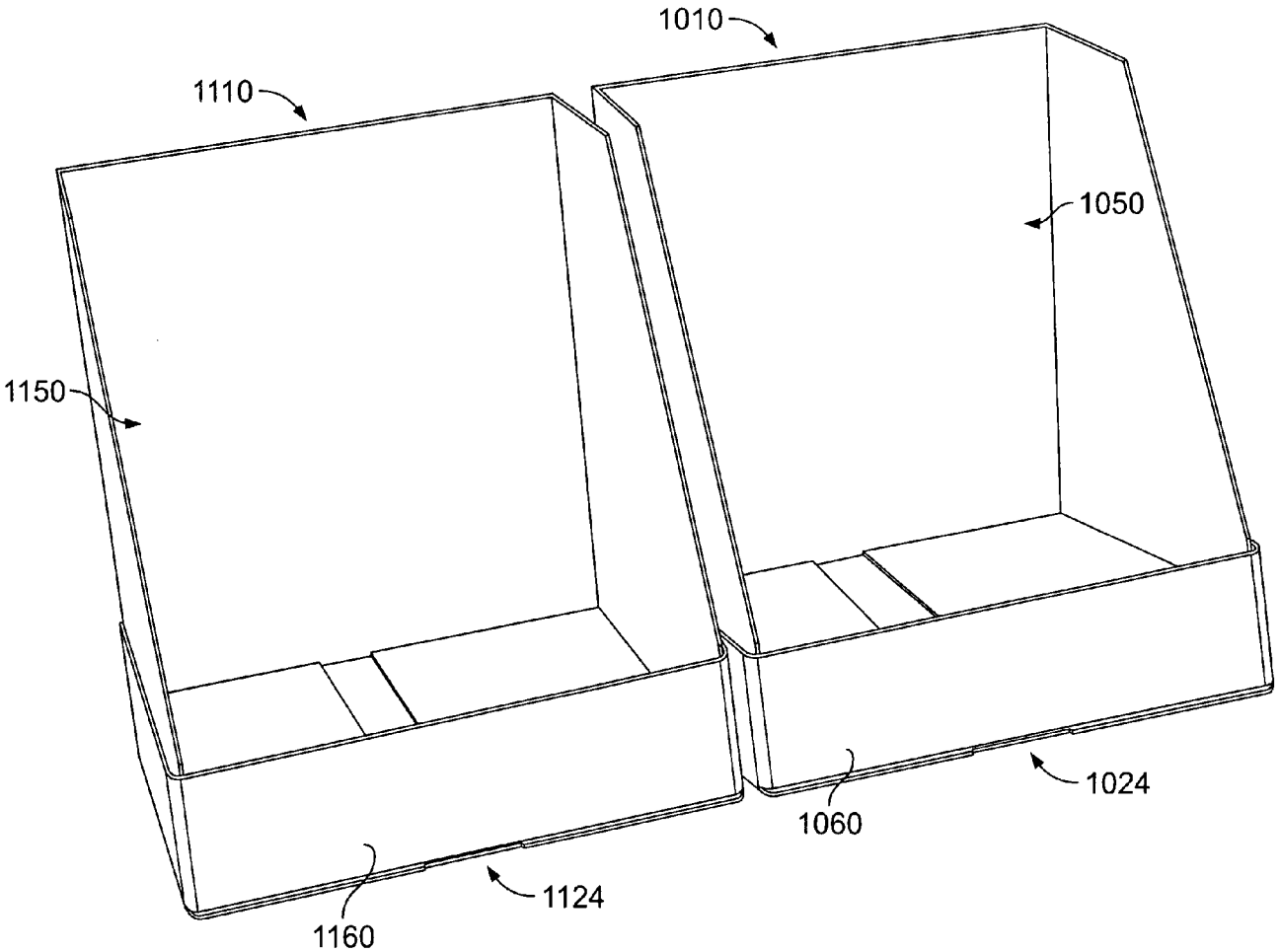
FIG. 21 is a perspective view of two display trays constructed from the twin-tray assembly shown in FIG. 19.

In an alternative embodiment, the product is packed flat in first display tray 1010 and second display tray 1110 such that the front panel of the product packaging faces top walls 1026, 1126. At the merchandising destination or point of sale site, at least a portion of coupling line 820 is torn to separate first inner side panel 840 from second inner side panel 942 and to separate bottom panel 822 from bottom panel 922. First display tray 1010 and second display tray 1110 are turned upwardly to position first display tray 1010 and second display tray 1110 in a display configuration. In the display configuration, first display tray 1010 and second display tray 1110 are positioned on the support surface, such as a shelf, such that respective back walls 1024, 1124 contact the shelf surface. In this configuration, each top wall 1026, 1126 is converted into a display front wall 1060, 1160, respectively, as shown in FIG. 21.

In the display configuration, first display tray 1010 and second display tray 1110 define a viewable display area 1050, 1150, respectively, for displaying the product positioned within cavity 1045, 1145, respectively.

Exemplary embodiments of a stackable shipping and display container and a method for constructing the shipping and display container are described above in detail. The container and method are not limited to the specific embodiments described herein, but rather, components of the container and/or steps of the method may be utilized independently and separately from other components and/or steps described herein. Further, the described container components and/or method steps can also be defined in, or used in combination with, other apparatus and/or methods, and are not limited to practice with only the container and method as described herein.

While the invention has been described in terms of various specific embodiments, those skilled in the art will recognize that the invention can be practiced with modification within the spirit and scope of the claims.

What is claimed is:

1. A blank of sheet material for constructing a stackable twin-tray assembly, the blank of sheet material having an interior surface and an opposing exterior surface, the blank comprising:

a first tray portion and a substantially similar second tray portion coupled to the first tray portion along a coupling line, the first tray portion and the second tray portion defining a cavity, each of the first tray portion and the second tray portion further comprising:

a bottom panel, a back panel and a top panel coupled together along preformed, generally parallel, fold lines, the bottom panel being substantially rectangular, wherein the bottom panel of the first tray portion is separably connected to the bottom panel of the second tray portion along the coupling line;

a first inner side panel and a second inner side panel coupled to the bottom panel, the first inner side panel extending from a first side edge of the bottom panel and the second inner side panel extending from an opposing second side edge of the bottom panel, the first inner side panel having a free top edge that includes at least a portion that is non-parallel to the first side edge and the second inner side panel having a free top edge that includes at least a portion that is non-parallel to the second side edge, wherein the first inner side panel of the first tray portion is separably connected to the second inner side panel of the second tray portion along the coupling line, and wherein the second inner side panel of the first tray portion is rotatable about the coupling line with respect to the first inner side panel of the second tray portion when the twin-tray assembly is erected and product is displayed within the first and second tray portions; and a first outer side panel and a second outer side panel coupled to the top panel, the first outer side panel extending from a first side edge of the top panel and configured for coupling to the first inner side panel, and the second outer side panel extending from an opposing second side edge of the top panel and configured for coupling to the second inner side panel for facilitating constructing the stackable twin-tray assembly.

2. A blank of sheet material according to claim 1 wherein each of the first tray portion and the second tray portion further comprises a first inner back panel coupled to the first inner side panel and a second inner back panel coupled to the second inner side panel, the first inner back panel extending from a first side edge of the first inner side panel perpendicular to the first side edge of the bottom panel and the second inner back panel extending from a first side edge of the second inner side panel perpendicular to the second side edge of the bottom panel, each of the first inner back panel and the second inner back panel configured for coupling to the back panel for facilitating constructing the stackable twin-tray assembly.

3. A blank of sheet material according to claim 2 wherein each of the first tray portion and the second tray portion further comprises a first outer back panel coupled to the first outer side panel and a second outer back panel coupled to the second outer side panel, the first outer back panel extending from a first side edge of the first outer side panel perpendicular to the first side edge of the top panel and configured for coupling to the back panel, the second outer back panel extending from a first side edge of the second outer side panel perpendicular to the second side edge of the top panel and configured for coupling to the back panel for facilitating constructing the stackable twin-tray assembly.

4. A blank of sheet material in accordance with claim 1 wherein the coupling line further comprises at least one of a line of separation and a line of weakening.

5. A blank of sheet material in accordance with claim 2 wherein the first side edge of the first inner side panel and the first side edge of the second inner side panel are parallel to and offset with respect a fold line coupling the bottom panel to the back panel to compensate for a thickness of the first inner back panel and the second inner back panel, respectively, when the stackable twin-tray assembly is constructed.

6. A blank of sheet material in accordance with claim 1 wherein a first side edge of the first outer side panel and a first side edge of the second outer side panel are parallel to and offset with respect to a fold line coupling the back panel to the top panel to compensate for a thickness of the back panel when the stackable twin-tray assembly is constructed.

7. A blank of sheet material in accordance with claim 1 wherein the free top edge of the first inner side panel is an angled edge that extends outwardly with respect to a longitudinal centerline of the blank from a leading edge of the first inner side panel to a trailing edge of the first inner side panel, and the free top edge of the second inner side panel is an angled edge that extends outwardly with respect to the longitudinal centerline from a leading edge of second inner side panel to a trailing edge of the second inner side panel.

8. A blank of sheet material according to claim 1 wherein the second inner side panel of the first tray portion is separable at the coupling line from the first inner side panel of the second tray portion when the twin-tray assembly is erected and product is displayed within the first and second tray portions.

9. A method for constructing a stackable twin-tray assembly from a blank of sheet material, wherein a first display tray and a second display tray are formable from the stackable twin-tray assembly, the method comprising:

providing the blank of sheet material including a first tray portion and a second tray portion each comprising a substantially rectangular bottom panel, the first tray portion bottom panel is separably coupled to the second tray portion bottom panel along a coupling line defined in the twin-tray assembly, each of the first tray portion and the second tray portion further comprising a first inner side panel connected to the respective bottom panel along a first side edge of the bottom panel, a second inner side panel connected to the respective bottom panel along a second side edge of the bottom panel, the first inner side panel has a free top edge that includes at least a portion that is non-parallel to the first side edge and the second inner side panel has a free top edge that includes at least a portion that is non-parallel to the second side edge, wherein the first inner side panel of the first tray portion is separably connected to the second inner side panel of the second tray portion along the coupling line, and the second inner side panel of the first tray portion is rotatable about the coupling line with respect to the first inner side panel of the second tray portion when the twin-tray assembly is erected and product is displayed within the first and second tray portions;

forming a first side wall of the twin-tray assembly by folding the first tray portion first inner side panel with respect to the first tray portion bottom panel and folding the second tray portion second inner side panel with respect to the second tray portion bottom panel;

forming a second side wall of the twin-tray assembly opposing the first side wall by folding the first tray portion second inner side panel with respect to the first tray portion bottom panel and folding the second tray portion first inner side panel with respect to the second tray portion bottom panel;

forming a first end wall of the twin-tray assembly defining a back wall of the first display tray;

forming a second end wall of the twin-tray assembly opposing the first end wall, the second end wall defining a back wall of the second display tray;

forming a first top wall of the twin-tray assembly defining a top wall of the first display tray; and forming a second top wall of the twin-tray assembly defining a top wall of the second display tray.

10. A method in accordance with claim 9 wherein forming the first side wall further comprises:

folding a first inner back panel of the first tray portion with respect to the first inner side panel of the first tray portion towards the first tray portion bottom panel; and folding a first inner back panel of the second tray portion with respect to the first inner side panel of the second tray portion towards the second tray portion bottom panel.

11. A method in accordance with claim 10 wherein forming the second side wall further comprises:

folding a second inner back panel of the first tray portion with respect to the second inner side panel of the first tray portion towards the first tray portion bottom panel; and folding a second inner back panel of the second tray portion with respect to the second inner side panel of the second tray portion towards the second tray portion bottom panel.

12. A method in accordance with claim 11 wherein forming the first end wall further comprises:

with the first inner side panel of the first display tray and the second inner side panel of the first display tray folded with respect to the first tray portion bottom panel, folding a back panel of the first display tray with respect to the first tray portion bottom panel; and coupling the back panel of the first display tray to each of the first inner back panel and the second inner back panel of the first display tray to partially form the first end wall.

13. A method in accordance with claim 11 wherein forming the second end wall further comprises:

with the first inner side panel and the second inner side panel of the second display tray folded with respect to the second tray portion bottom panel, folding a back panel of the second display tray with respect to the second tray portion bottom panel; and coupling the back panel of the second display tray to each of the first inner back panel and the second inner back panel of the second display tray to partially form the second end wall.

14. A method in accordance with claim 11 wherein forming a first side wall of the twin-tray assembly further comprising:

folding a top panel of the first display tray with respect to a back panel of the first display tray to form the top wall of the first display tray;

folding a first outer side panel of the first display tray with respect to the top panel of the first display tray towards the first inner side panel of the first display tray; and coupling the first outer side panel of the first display tray to the first inner side panel of the first display tray to partially form the first side wall.

15. A method in accordance with claim 14 further comprising:

folding a second outer side panel of the first display tray with respect to the top panel of the first display tray towards the second inner side panel of the first display tray; and coupling the second outer side panel of the first display tray to the second inner side panel of the first display tray to partially form the second side wall.

16. A method in accordance with claim 11 further comprising:

folding a top panel of the second display tray with respect to the back wall of the second display tray to form the top wall of the second display tray;

folding a first outer side panel of the second display tray with respect to the top panel of the second display tray towards the first inner side panel of the second display tray;

coupling the first outer side panel of the second display tray to the first inner side panel of the second display tray to partially form the first side wall;

folding a second outer side panel of the second display tray with respect to the top panel of the second display tray towards the second inner side panel of the second display tray; and coupling the second outer side panel of the second display tray to the second inner side panel of the second display tray to partially form the second side wall.

17. A method in accordance with claim 9 further comprising:

folding a first outer back panel of the first display tray with respect to a first outer side panel of the first display tray towards an exterior surface of a back panel of the first display tray;

coupling the first outer back panel of the first display tray to the back panel of the first display tray;

folding a second outer back panel of the first display tray with respect to a second outer side panel of the first display tray towards the exterior surface of the back panel of the first display tray; and coupling the second outer back panel of the first display tray to the back panel of the first display tray to form the first end wall.

18. A method in accordance with claim 9 further comprising:

folding a first outer back panel of the second display tray with respect to a first outer side panel of the second display tray towards an exterior surface of a back panel of the second display tray;

coupling the first outer back panel of the second display tray to the back panel of the second display tray;

folding a second outer back panel of the second display tray with respect to a second outer side panel of the second display tray towards the exterior surface of the back panel of the second display tray; and coupling the second outer back panel of the second display tray to back panel of the second display tray to form the second end wall.

19. A method in accordance with claim 9 further comprising:

positioning product with respect to the bottom wall of the first and second tray portions;

separating the first inner side panel of the first tray portion and the second inner side panel of the second tray portion along the coupling line;

separating the bottom panel of the first tray portion and the bottom panel of the second tray portion along the coupling line; and rotating the second inner side panel of the first tray portion about the coupling line towards the first inner side panel of the second tray portion to form the first display tray and the second display tray from the stackable twin-tray assembly.

20. A method in accordance with claim 9 wherein the second inner side panel of the first tray portion is separable at the coupling line from the first inner side panel of the second tray portion when the twin-tray assembly is erected and product is displayed within the first and second tray portions.

* * * * *